US005764116A

United States Patent [19]

Ishikawa et al.

[11] Patent Number: 5,764,116

[45] Date of Patent: Jun. 9, 1998

[54] DIELECTRIC RESONATOR AND FILTER UTILIZING A NONRADIATIVE DIELECTRIC WAVEGUIDE DEVICE

[75] Inventors: Yohei Ishikawa, Kyoto; Toshiro Hiratsuka, Kusatsu; Kenichi Iio, Nagaokakyo; Sadao Yamashita, Kyoto, all of Japan

[73] Assignee: Murata Manufacturing Co., Ltd., Japan

[21] Appl. No.: 620,918

[22] Filed: Mar. 22, 1996

[30] Foreign Application Priority Data

Mar. 22, 1995 [JP] Japan ..... 7-062625

[51] Int. Cl.[6] ..... H01P 1/20; H01P 7/10

[52] U.S. Cl. ..... 333/202; 333/219.1; 333/248

[58] Field of Search ..... 333/202, 219, 333/219.1, 208, 248

[56] References Cited

U.S. PATENT DOCUMENTS

| | | | |
|---|---|---|---|
| 2,923,901 | 2/1960 | Robertson | 333/208 |
| 4,727,342 | 2/1988 | Ishikawa et al. | 333/219 |
| 4,757,285 | 7/1988 | Krause | 333/202 X |
| 4,812,791 | 3/1989 | Makimoto | 333/219 |
| 4,897,623 | 1/1990 | Reindel | 333/208 |
| 5,484,764 | 1/1996 | Fiediuszko et al. | 333/219 X |

FOREIGN PATENT DOCUMENTS

| | | | |
|---|---|---|---|
| 0059001 | 3/1988 | Japan | 333/208 |
| 1196977 | 12/1985 | U.S.S.R. | 333/219 |
| 752467 | 7/1956 | United Kingdom . | |

OTHER PUBLICATIONS

European Search Report on European Patent Application No. EP 96 10 4543; Jun. 4, 1996.

*Primary Examiner*—Robert Pascal
*Assistant Examiner*—Barbara Summons
*Attorney, Agent, or Firm*—Ostrolenk, Faber, Gerb & Soffen, LLP

[57] ABSTRACT

A dielectric resonator capable of resonating at a predetermined resonance frequency has a dielectric substrate, a first electrode formed on a first surface of the dielectric substrate and having a first opening, a second electrode formed on a second surface of the dielectric substrate and having a second opening, a first conductor plate disposed by being spaced apart from the dielectric substrate by a predetermined distance, and a second conductor plate disposed by being spaced apart from the dielectric substrate by a predetermined distance. The region of the dielectric substrate defined between the first and second electrodes, a free space defined between the first electrode and the first conductor plate and another free space defined between the second electrode and the second conductor plate are cut-off regions for attenuating a high-frequency signal having the same frequency as the resonance frequency. This dielectric resonator can be used in a millimeter wave band, can resonate with markedly small variations of its resonance frequency even if the temperature thereof varies, and can be manufactured at a low cost.

8 Claims, 31 Drawing Sheets

DIELECTRIC RESONATOR AND FILTER UTILIZING A NONRADIATIVE DIELECTRIC WAVEGUIDE DEVICE

BACKGROUND OF THE INVENTION

1. Field of the Invention

The present invention relates to a dielectric resonator and a high-frequency band-pass filter for operation in a microwave or millimeter-wave band.

2. Description of the Related Art

The demand for mobile communication systems in the 900 MHz band and the near-microwave band has increased rapidly in recent years and a deficiency of usable frequencies may occur in the future. In order to develop systems adapted to multimedia communications, communication systems for transmitting still images or video images are being studied. Such communication systems must be realized as large-capacity high-speed communication systems. The use of the millimeter wave frequency bands, which are practically unused, has been taken into consideration because the bandwidth, the capacity and the communication speed of a communication channel can easily be increased in the millimeter wave band.

Use of millimeter waves to communicate within a small cell called a pico-cell has also be taken into consideration to make use of their characteristically large losses caused by absorption into the air. A mobile communication system using such a millimeter wave band pico-cell has a very small radio communication zone and therefore requires a much greater number of base stations than the systems using the near-microwave bands and other lower bands. Therefore, a smaller filter which is mass-producible at a lower cost in comparison with conventional filters is required for base stations for mobile communication in such a millimeter wave band pico-cell.

Conventionally, waveguide filters have generally been used as microwave and millimeter wave band filters. Recently, however, $TE_{01\delta}$ mode dielectric filters using a $TE_{01\delta}$ mode dielectric resonator have come into wide use in microwave bands in place of high-priced waveguide filters. $TE_{01\delta}$ mode dielectric filters are constructed in such a manner that a plurality of cylindrical $TE_{01\delta}$ mode dielectric resonators are arranged at predetermined intervals in a rectangular waveguide having a cut-off frequency higher than that of the dielectric resonators. A prototype of this kind of filter was reported by Cohn in 1967 and studies for putting it to practical use in broadcasting apparatuses were thereafter advanced. In 1975, Wakino et al. made a practical filter of this kind having high stability with respect to temperatures by using a temperature-characteristic-compensated dielectric. In general, the temperature characteristics of dielectric resonator filters are determined by the temperature characteristics of the material of the resonator. Therefore, dielectric resonator filters have the advantage of being free from the need for using an expensive metal such as Kovar (registered trademark of Westinghouse Co.) or Invar (registered trademark of Société Creusot-Loire) to form the cavity.

A filter having waveguides as input and output means has been reported as an example of use of a $TE_{01\delta}$ mode dielectric resonator in a millimeter wave band. A filter using as input and output means a nonradiative dielectric waveguide (hereinafter referred to as an "NRD guide") invented by Yoneyama et al. for the purpose of reducing losses has also been reported. These filters have small losses and good characteristics even in a millimeter wave band.

However, the resonance frequency of $TE_{01\delta}$ mode dielectric resonators is determined by the size of a cylindrical dielectric member therein. The size of this cylindrical member is very small, that is, the height is 0.37 mm and the diameter is 1.6 mm at 60 GHz. Therefore, if a $TE_{01\delta}$ mode dielectric resonator is manufactured with the level of working accuracy presently achievable in a mass-production process, variations of resonance frequency from unit to unit will be considerable.

When a $TE_{01\delta}$ mode dielectric filter is constructed by using a plurality of $TE_{01\delta}$ mode dielectric resonators, it is necessary to arrange the $TE_{01\delta}$ mode dielectric resonators at predetermined intervals with high accuracy in a waveguide. In practice, it is difficult to manufacture the filter with such high accuracy. Therefore, in a case where a dielectric filter having desired filter characteristics in a millimeter wave band is manufactured, there is a need to provide each of a plurality of $TE_{01\delta}$ dielectric resonators with a resonance frequency adjustment means for finely adjusting the resonance frequency of the resonator and there is also a need to provide, between each adjacent pair of the $TE_{01\delta}$ dielectric resonators, a coupling adjustment means for finely adjusting the amount of coupling between the pair of $TE_{01\delta}$ dielectric resonators, resulting in a considerable increase in manufacturing cost.

SUMMARY OF THE INVENTION

In view of the above-described problems, an object of the present invention is to provide a dielectric resonator which can be used in a millimeter wave band, in which variation of the resonance frequency with respect to changes in temperature can be further reduced in comparison with the conventional $TE_{01\delta}$ dielectric resonators, and which is low-priced in comparison with the conventional $TE_{01\delta}$ dielectric resonators.

Another object of the present invention is to provide a high-frequency band-pass filter which can be used in a millimeter wave band, which is low-priced in comparison with the conventional $TE_{01\delta}$ dielectric filters, which can be manufactured with high accuracy, and which has means for finely adjusting the resonance frequencies and the coupling of the resonators.

To achieve these objects, according to one aspect of the present invention, there is provided a dielectric resonator capable of resonating at a predetermined resonance frequency, the dielectric resonator having: a dielectric substrate having a first surface and a second surface opposite from each other; a first electrode formed on the first surface of the dielectric substrate and having a first opening formed in a predetermined shape over a central portion of the first surface of the dielectric substrate; a second electrode formed on the second surface of the dielectric substrate and having a second opening formed in substantially the same shape as the first opening and positioned opposite from the first opening; a first conductor plate disposed by being spaced apart from the first surface of the dielectric substrate by a predetermined distance, a portion of the first conductor plate facing the first opening; and a second conductor plate disposed by being spaced apart from the second surface of the dielectric substrate by a predetermined distance, a portion of the second conductor plate facing the second opening. The thickness and the dielectric constant of the dielectric substrate is determined such that the portion of the dielectric substrate other than a resonator formation region defined between the first opening and the second opening attenuates a signal of a predetermined resonance frequency.

The spacing between the first surface of the dielectric substrate and the first conductor plate is determined so that a signal of the resonance frequency is attenuated between the first electrode and the first conductor plate. Also, the spacing between the second surface of the dielectric substrate and the second conductor plate is determined so that a signal of the resonance frequency is attenuated between the second electrode and the second conductor plate.

According to another aspect of the present invention, a dielectric member may be provided in at least one of a space between the first electrode and the first conductor plate and a space between the second electrode and the second conductor plate.

According to still another aspect of the present invention, each of the first and second openings may be circular.

The resonator may further comprise a cavity formed at least partially by the first and second conductor plates, an electromagnetic field of the dielectric resonator being confined in the cavity.

According to a further aspect of the present invention, there is provided a high-frequency band-pass filter having a dielectric resonator constructed as described above, input means for inputting a high-frequency signal to the dielectric resonator, and output means for outputting a high-frequency signal from the dielectric resonator.

In the high-frequency band-pass filter, at least one of the input means and the output means comprises a nonradiative dielectric waveguide.

According to still another aspect of the present invention, there is provided a high-frequency band-pass filter having a plurality of dielectric resonators constructed as described above, the dielectric electrodes being arranged at predetermined intervals, input means for inputting a high-frequency signal to the dielectric resonators, and output means for outputting a high-frequency signal from the dielectric resonators.

In the filter, at least one of the input means and the output means comprises a nonradiative dielectric waveguide.

In the dielectric resonator of the present invention, a portion of the dielectric substrate defined between the first and second openings forms a resonator formation region in which a standing wave occurs when a high-frequency signal having the same frequency as the resonance frequency is input. On the other hand, the portion of the dielectric substrate other than the resonator formation region, interposed between the first and second electrodes, forms a cut-off region for attenuating a high-frequency signal having the same frequency as the resonance frequency. Also, each of the spaces between the first electrode and the first electrode plate and between the second electrode and the second electrode plate forms a cut-off region for attenuating a high-frequency signal having the same frequency as the resonance frequency. When the dielectric resonator is excited by a signal of the resonance frequency, the electromagnetic field of this signal is distributed through the resonator formation region between the first and second openings and is also distributed in and in the vicinity of the free space between the first opening and the first conductor plate and the free space between the second opening and the second conductor plate, thereby causing the dielectric resonator to resonate.

The high-frequency band-pass filter device provided in the second aspect of the invention has the input and output means and is arranged so that only a high-frequency signal input by the input means and having a predetermined frequency passes the dielectric resonator to be output by the output means.

The high-frequency band-pass filter device provided in the third aspect of the invention has a plurality of dielectric resonators constructed as described above and arranged at predetermined intervals, has the input and output means, and is arranged so that a high-frequency signal input by the input means and having a predetermined frequency passes the dielectric resonators to be output by the output means.

According to the present invention, the first electrode having the first opening and the second electrode having the second opening are formed on the two opposite surfaces of dielectric substrate opposite from each other. The first and second openings can be formed with high dimensional accuracy by using photolithography techniques. The dielectric resonator formed in this manner can be used in a millimeter wave band, can resonate with markedly small variation of the resonance frequency even if the temperature thereof varies, and can be manufactured at a low cost.

According to the present invention, a dielectric member is provided in at least one of a space between the first electrode and the first conductor plate and a space between the second electrode and the second conductor plate, so that the dielectric resonator of the present invention can be smaller in thickness than dielectric resonators in which no dielectric member is provided in the above-described manner.

According to the present invention, each of the first and second openings is circular and can therefore be formed more easily in comparison with openings having different shapes.

According to the present invention, the cavity is provided and is formed at least partially by the first and second conductor plates. Therefore, the non-load Q can be increased in comparison with a device having no cavity. Also, variations of the resonance frequency can be reduced.

The high-frequency band-pass filter in accordance with the present invention is provided with the dielectric resonator, the input means and the output means described above. Therefore, it can be used in a millimeter wave band and can be provided at a low cost.

In the high-frequency band-pass filter in accordance with the present invention, at least one of the input means and the output means comprises an NRD guide. The above-described dielectric resonator and the input means or output means using the NRD guide can easily be coupled with each other.

The high-frequency band-pass filter in accordance with the present invention may be provided with a plurality of dielectric resonators constructed as described above and arranged at predetermined intervals to be able to provide a larger amount of attenuation in the bands to be blocked in comparison with high-frequency band-pass filter devices having only one dielectric resonator. Also in this case, at least one of the input means and the output means comprises an NRD guide. The above-described dielectric resonator and the input means or output means using the NRD guide can easily be coupled with each other.

BRIEF DESCRIPTION OF THE DRAWINGS

FIG. 6(*b*) is a cross-sectional view taken along the line B-B' of FIG. 6(*a*);

FIG. 10(*b*) is a cross-sectional view taken along the line C-C' of FIG. 10(*a*);

FIG. 18(*b*) is a longitudinal sectional view taken along the line G-G' of FIG. 18(*a*);

DESCRIPTION OF THE PREFERRED EMBODIMENTS

<First Embodiment>

Figure 1:
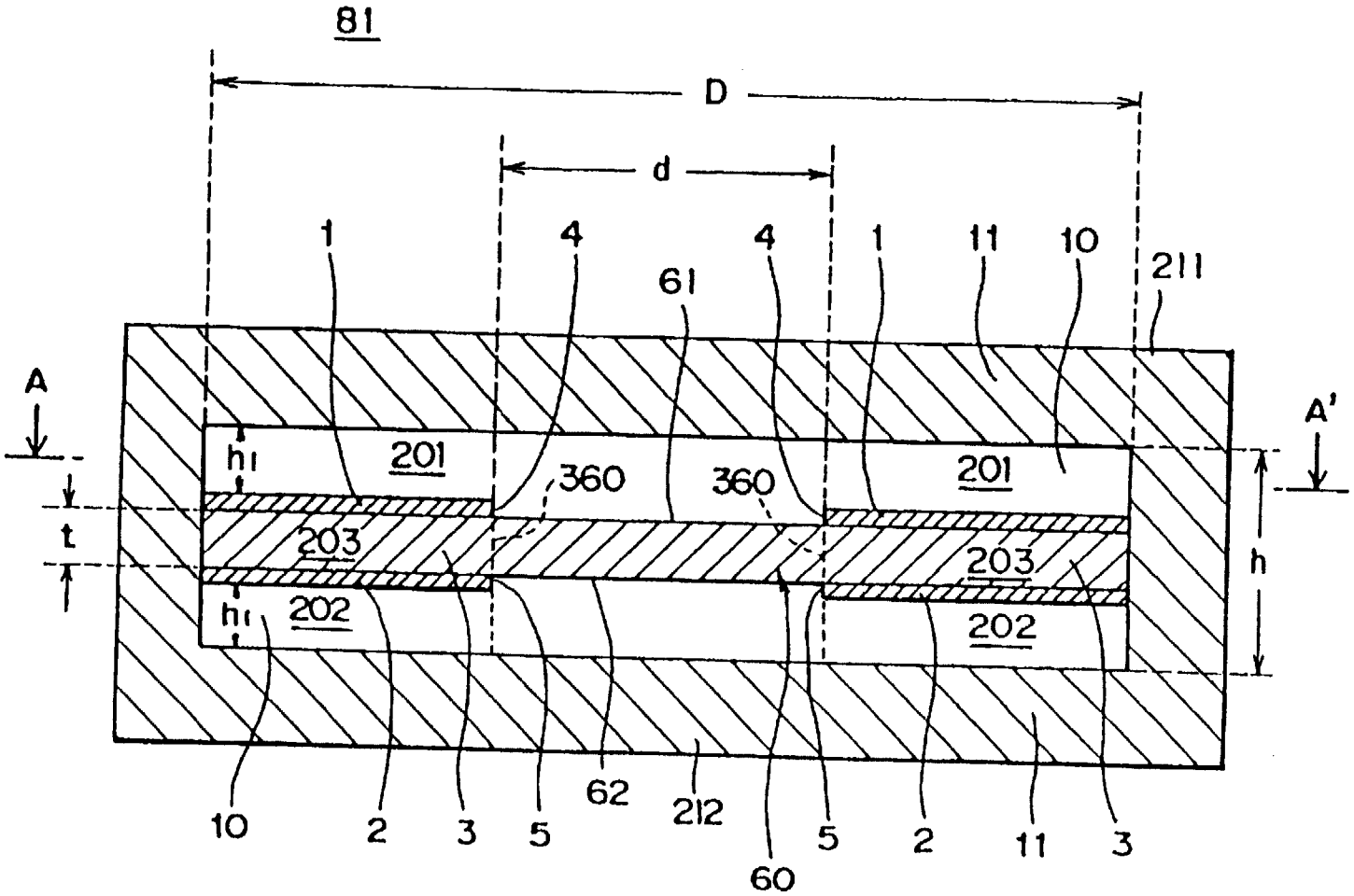
FIG. 1 is a longitudinal sectional view of a $TE_{010}$ mode dielectric resonator in accordance with a first embodiment of the present invention.
Figure 2:
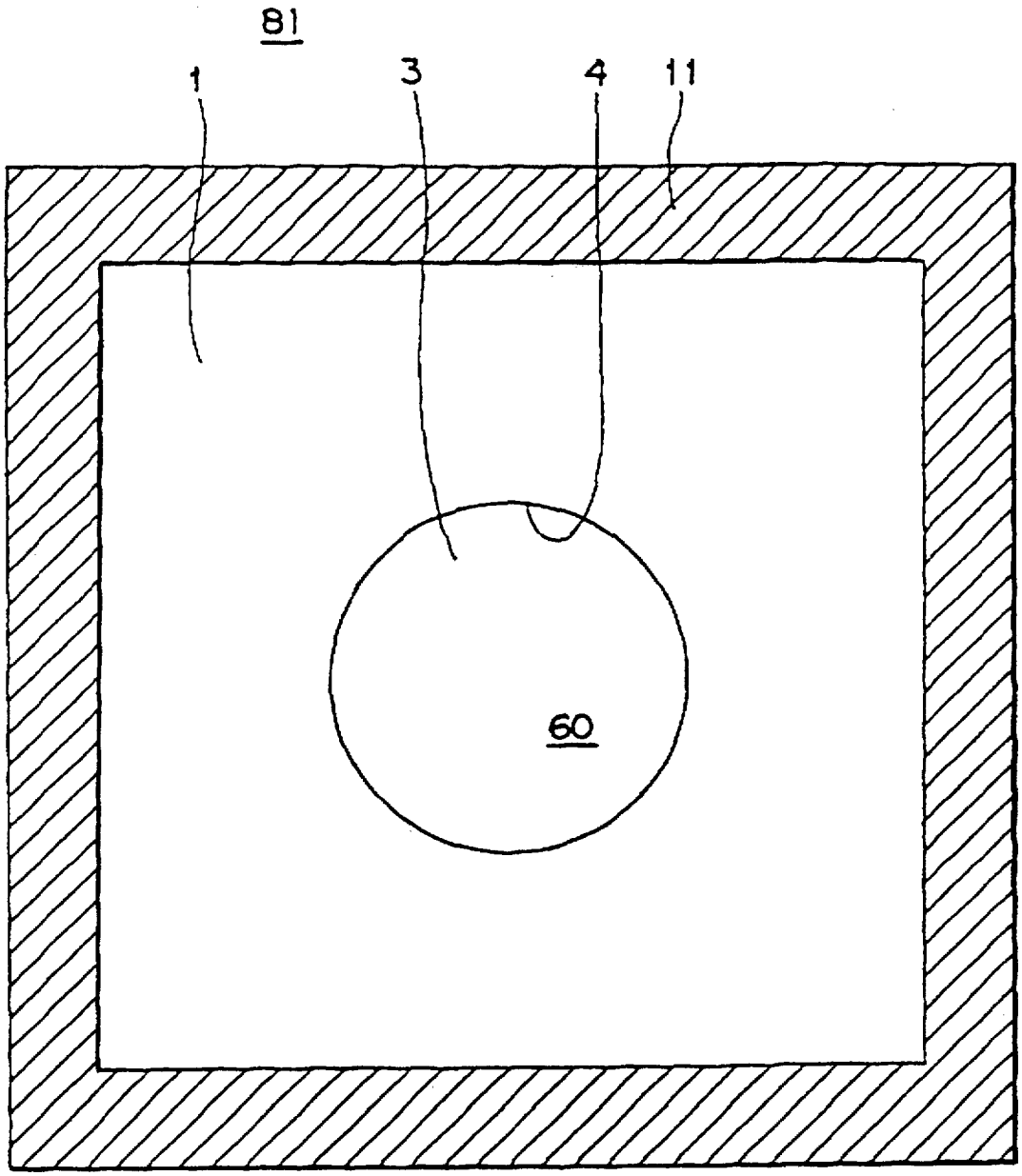
FIG. 2 is a cross-sectional view taken along the line A-A' of FIG. 1.

A $TE_{010}$ mode dielectric resonator 81 in accordance with the present invention will be described below in detail with reference to the accompanying drawings. FIG. 1 is a longitudinal sectional view and FIG. 2 is a cross-sectional view taken along line A-A' of FIG. 1.

As shown in FIG. 1, an electrode 1 is formed on an upper surface of a dielectric substrate 3, the electrode 1 having a circular opening 4 having a diameter d at a center of the upper surface of the dielectric substrate 3. Also, an electrode 2 having an opening 5 having substantially the same shape as the opening 4 is formed on a lower surface of the dielectric substrate 3. The dielectric substrate 3 has a dielectric constant $\epsilon_r$ and has a square shape each side of which has a length D. The diameter d of the openings 4 and 5 is smaller than the length of each side of the dielectric substrate 3, and the openings 4 and 5 share a common central axis. Accordingly, a region 60 forming a cylindrical resonator is defined in the dielectric substrate 3. The region 60 is formed at the center of the dielectric substrate 3 and has an upper surface 61 and a lower surface 62. The region 60 also has a virtual circumferential surface 360 in the dielectric substrate 3. The values of the dielectric constant $\epsilon_r$ and the thickness t of the dielectric substrate 3 and the diameter d of the openings 4 and 5 are determined to be such that a standing wave occurs when a high-frequency signal of a resonance frequency of the $TE_{010}$ mode dielectric resonator 81 is applied to the region 60.

The electrode 1 is formed on the entire area of the upper surface of the dielectric substrate 3 except for the upper surface 61 while the electrode 2 is formed on the entire area of the lower surface of the dielectric substrate 3 except for the lower surface 62. An annular portion of the dielectric substrate 3 other than the region 60 is interposed between the electrodes 1 and 2 to form a parallel-plate waveguide. The dielectric constant $\epsilon_r$ and the thickness t of the dielectric substrate 3 are set to such values that a cut-off frequency of this parallel-plate waveguide in a $TE_{010}$ mode, which is a fundamental propagation mode of the parallel-plate waveguide, is higher than the resonance frequency of the $TE_{010}$ mode dielectric resonator 81. That is, the annular portion of the dielectric substrate 3 other than the region 60, interposed between the electrodes 1 and 2, forms a region 203 for attenuating a signal of the resonance frequency. In other words, the dielectric constant $\epsilon_r$ and the thickness t of the dielectric substrate 3 are selected so that the region 203 attenuates a signal of the resonance frequency.

The dielectric substrate 3 with the electrodes 1 and 2 is provided in a cavity 10 formed in a conductor case 11. The conductor case 11 is formed by square shaped upper and lower conductor plates 211 and 212 and four side conductor plates. Inside the conductor case 11, the cavity 10 is formed as a square prism having a height h and a square cross section, each side of which has the length D. The dielectric substrate 3 is placed in the cavity 10 so that the side surfaces of the dielectric substrate 3 contact the side conductor plates of the conductor case 11, and so that the distance between the upper surface of the dielectric substrate 3 and the upper conductor plate 211 of the conductor case 11 and the distance between the lower surface of the dielectric substrate 3 and the lower conductor plate 212 of the conductor case 11 are approximately equal to each other and equal to a distance h1 as shown in FIG. 1. A free space formed between the electrode 1 and the portion of the upper conductor plate 211 other than the portion of the same facing the upper surface 61 of the dielectric substrate 3 forms a parallel-plate waveguide. The distance h1 is set to such a value that a cut-off frequency of this parallel-plate waveguide in a $TE_{010}$ mode which is a fundamental propagation mode of this parallel-plate waveguide is higher than the resonance frequency. That is, the free space between the electrode 1 and the portion of the upper conductor plate 211 other than the portion of the same facing the upper end surface 61 of the dielectric substrate 3 forms a region 201 for attenuating a signal having the resonance frequency. In other words, the distance h1 is selected so that the region 201 attenuates a signal having the resonance frequency. A dielectric material may be inserted into the region 201 to control the dielectric characteristic of the region.

Similarly, a free space formed between the electrode 2 and the portion of the lower conductor plate 212 other than the portion facing the lower end surface 62 of the dielectric substrate 3 forms a parallel-plate waveguide. The distance h1 between the electrode 2 on the dielectric substrate 3 and the lower conductor plate 212 of the conductor case 11 is set to such a value that a cut-off frequency of this parallel-plate waveguide in a $TE_{010}$ mode which is a fundamental propagation mode of this parallel-plate waveguide is higher than the resonance frequency. That is, the free space between the electrode 2 and the portion of the lower conductor plate 212 other than the portion of the same facing the lower end surface 62 of the dielectric substrate 3 forms an attenuation region 202 for attenuating a high-frequency signal having the same frequency as the resonance frequency. In other words, the distance h1 is selected so that the attenuation region 202 attenuates a high-frequency signal having the same frequency as the resonance frequency.

Figure 3:
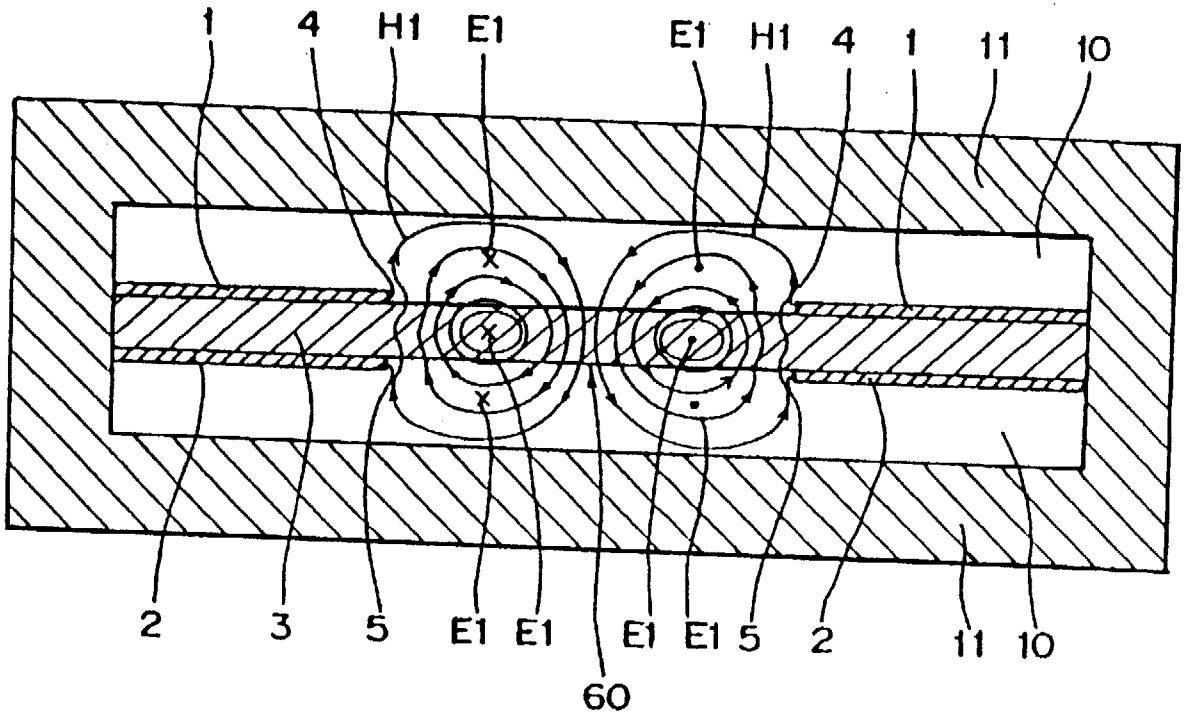
FIG. 3 is a longitudinal sectional view corresponding to FIG. 1, showing magnetic and electric distributions along the sectional plane.

In the resonator 81, the region 60, in which a standing wave occurs in response to a signal having the resonance frequency, is formed at the center of the dielectric substrate 3, while the attenuating regions 201, 202, and 203 which attenuate a signal having the resonance frequency of the resonator 81 are formed around the region 60. When the resonator 81 of the first embodiment is excited by a high-frequency signal having the resonance frequency, the electromagnetic field, as shown in FIG. 3, is confined to resonate in the region 60 and in free spaces in the vicinity of the region 60.

Figure 4:
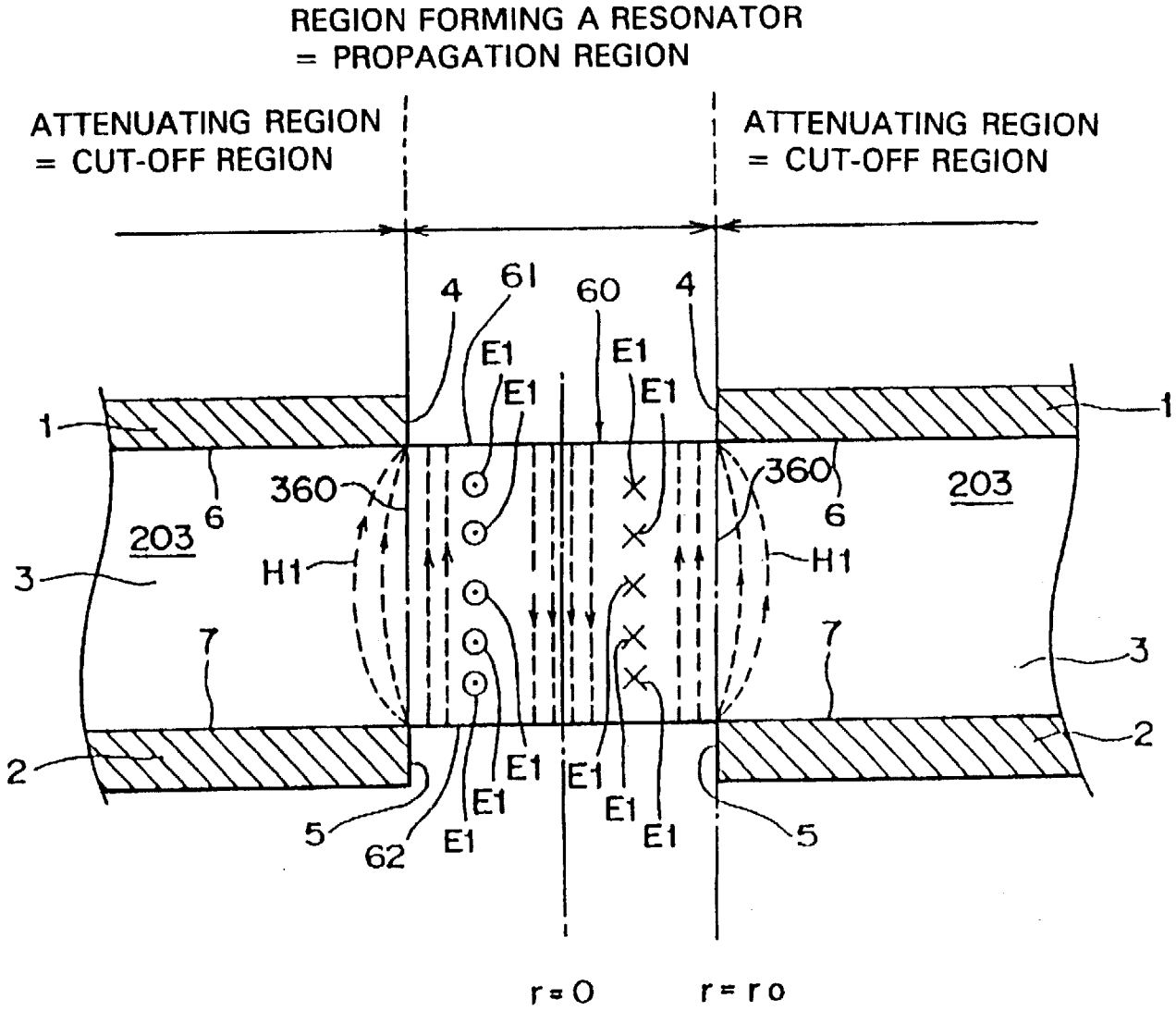
FIG. 4 is a longitudinal sectional view of the dielectric substrate, showing the principle of resonation of the $TE_{010}$ mode dielectric resonator of the first embodiment.

The principle of the operation of the resonator 81 will next be described in detail. FIG. 4 is a cross-sectional view of a portion of the dielectric substrate 3. In FIG. 4, the upper surface 61 and the lower surface 62 may be assumed to be magnetic walls.

In the region 60 between these surfaces, a cylindrical wave, $TE_{00-}$ mode, having propagation vectors only in directions toward the axis of the region 60 or a cylindrical wave, $TE_{00+}$ mode, having propagation vectors only in directions from the axis of the region 60 toward a circumferential surface 360 exists as a propagation mode. The subscripts (+) and (−) attached to TE respectively denote a cylindrical wave having propagation vectors only in directions toward the axis of the region 60 and a cylindrical wave having propagation vectors only in directions from the axis of the region 60 toward the circumferential surface 360. The lower surface 6 of the electrode 1 in contact with the upper surface of the dielectric substrate 3 and the upper surface 7 of the electrode 2 in contact with the lower surface of the dielectric substrate 3 function as electric walls.

A cylindrical wave is an electromagnetic wave which can be expressed by a cylindrical function such as a Bessel Function or Hankel function. In the following description, a cylindrical coordinate system is used in which the z-axis is set along the axis of the region 60, the distance in a radial direction from the axis of the region 60 is represented by r, and the angle centering around the axis in the plane perpendicular to the axis is represented by ø.

Under the above-described boundary conditions, an electromagnetic field of a $TE_{0m0}$ mode can be expressed by equations (1) and (2) by using the cylindrical coordinate system. In the equations (1) and (2), Hz represents a magnetic field in the axial direction, i.e. the direction of the z-axis, of the region 60, and Eø represents an electric field in the ø-direction. Also, $k_0$ is a wavelength constant, ω is the angular frequency, and μ is the permeability of the dielectric substrate 3.

$$H_z=k_0^2U \tag{1}$$

$$E\phi=j\omega\mu(\partial U/\partial r) \tag{2}$$

In these equations, U is a scalar potential of an electromagnetic field, which is ordinarily expressed by superposition of a cylindrical wave having propagation vectors only in directions toward the axis of the region 60 and a cylindrical wave having propagation vectors only in directions from the axis of the region 60 toward the circumferential surface 360. That is, it can be expressed by the following equation (3) using constants $c_1$ and $c_2$, $H_0^{(1)}(k_r r)$ which is a 0-order first Hankel function and $H_0$ (2) $(k_r r)$ which is a 0-order second Hankel function:

$$U=c_1H_0^{(1)}(k_r r)+c_2H_0^{(2)}(k_r r) \tag{3}$$

where $k_r$ is an eigenvalue determined by the boundary condition in the direction of the radius vectors. It is necessary to satisfy a perfect standing wave condition: $c_1=c_2$ in order that both the magnetic field $H_z$ and the electric field Eø be finite on the axis of the resonator formation region at which r=0. From this condition and expressions (4) and (5), a scalar potential of the electromagnetic field U can be expressed by equation (6) using $J_0(k_r r)$ which is a 0-order first Bessel function.

$$H_0^{(1)}(k_r r)=J_0(k_r r)+jY_0(k_r r) \tag{4}$$

$$H_0^{(2)}(k_r r)=J_0(k_r r)-jY_0(k_r r) \quad (5)$$

$$U=AJ_0(k_r r) \quad (6)$$

where $A=c_1+c_2$.

From equations (1), (2) and (6), the magnetic field Hz and the electric field Eø can be respectively expressed by the following equations (7) and (8):

$$H_z=Ak_0^2J_0(k_r r) \quad (7)$$

$$E\phi=j\omega\mu k_r AJ_1(k_r r) \quad (8)$$

It is necessary to set $k_r$ to such a value as to satisfy the following equation (9) in order that the electric field Eø be substantially zero at the virtual circumferential surface 360 of the region 60 at which $r=r_0=d/2$.

$$k_r r_0=3.832 \quad (9)$$

The magnetic field Hz and the electric field Eø in the resonating state in the $TE_{010}$ mode can be obtained by substituting in equations (7) and (8) the value of $k_r$ satisfying this equation (9).

Figure 5:
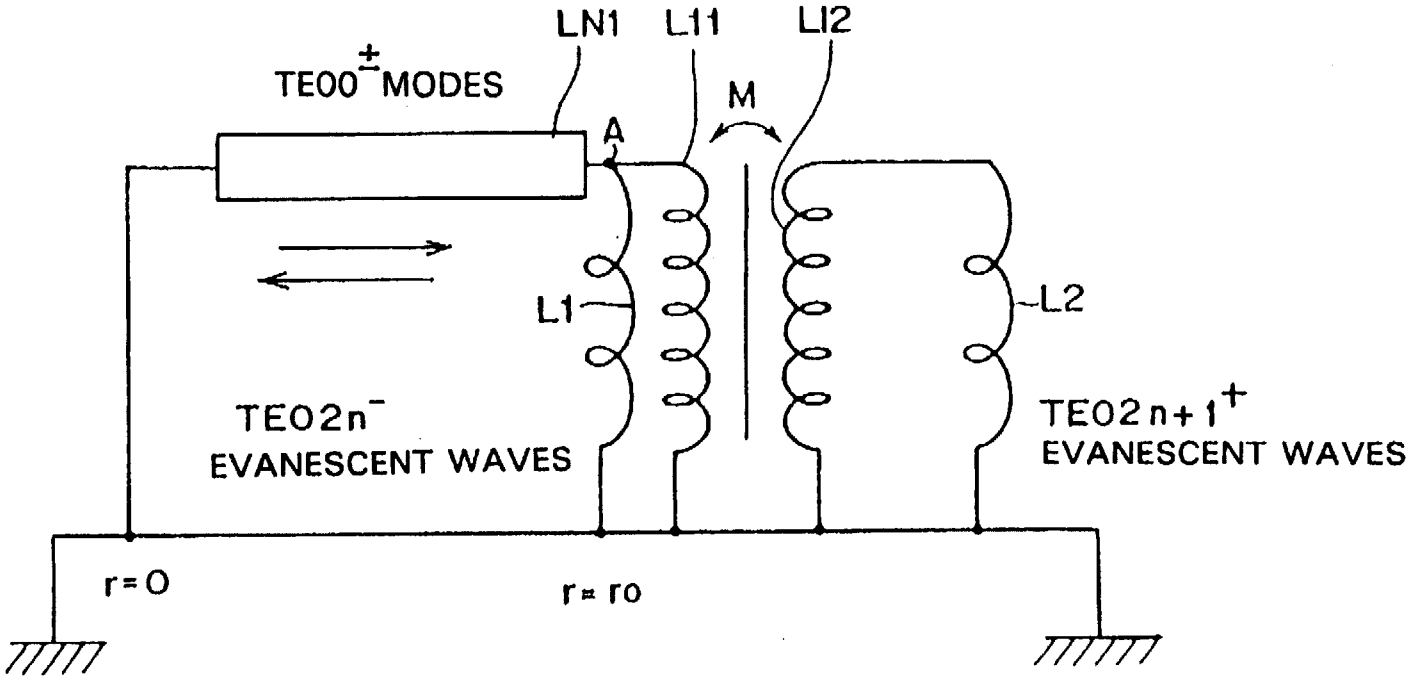
FIG. 5 is a circuit diagram showing an equivalent circuit of the $TE_{010}$ mode dielectric resonator of the first embodiment.

Thus, the magnetic field Hz and the electric field Eø have been obtained under the condition that Eø=0 is satisfied when $r=r_0$, that is, the electric field Eø is zero at the virtual circumferential surface 360 of the region 60. Actually, however, the $TE_{0n}^{\pm}$ modes, which are high-order modes, may occur in the vicinity of the surfaces of the electrodes 1 and 2 at the circumferences of the openings 4 and 5, and the magnetic field $H_z$ and the electric field Eø may couple with electromagnetic fields of the $TE_{0n}^{\pm}$ modes, so that distortions may occur in the magnetic field Hz and the electric field Eø. In $TE_{0n}^{\pm}$, n represents even numbers. This condition can be expressed in an equivalent circuit, as shown in FIG. 5. In FIG. 5, a transmission line LN1 represents a path of propagation in $TE_{0n}^{\pm}$ modes in the region 60 toward the axis of the region 60 and from the axis of the region 60 toward the circumferential surface 360. If there is no electric field at the circumferential surface 360 at which $r=r_0$, that is, if the circuit as seen rightward from a point A is electrically short-circuited, resonance occurs only in the fundamental wave, $TE_{010}$ mode, to satisfy equation (9).

In the case of the present model, however, the boundary conditions are discontinuous at $r=r_0$, so that the cylindrical wave couples with evanescent waves in $TE_{0'2n}^{-}$ modes with respect to $n\geqq 1$ in the region 60, and couples with evanescent waves in $TE_{0'2n+1}^{+}$ modes with respect to $n\geqq 0$ in the attenuation region 203 between the electric walls. Accordingly, in the equivalent circuit of FIG. 5, an inductor L1 represents magnetic energy of evanescent waves in $TE_{0'2n}^{-}$ modes while an inductor L2 represents magnetic energy of evanescent waves in $TE_{0'2n+1}^{+}$ modes. Also, inductors L11 and L12 represent magnetic energy of the corresponding regions and couple with each other by inductive coupling.

As can be understood from this equivalent circuit, the perfect standing wave condition of the $TE_{00}^{+}$ and $TE_{00}^{-}$ modes can always be satisfied although the resonance frequency of the $TE_{010}$ mode dielectric resonator 81 varies depending upon the reactance determined by the inductors L1 and L11 connected to the point A.

In this model, the upper and lower surfaces of the propagation region, i.e., the upper end surface 61 and the lower end surface 62 of the region 60, are assumed to be magnetic walls. In an actual model, however, the resonance frequency becomes higher by several tens of percentage points by the effect of magnetic perturbation of the upper and lower conductor plates of the conductor case 11 in comparison with the case where there is no magnetic perturbation.

The result of electromagnetic field analysis made with respect to the $TE_{010}$ mode dielectric resonator 81 of the first embodiment will next be described. Methods have been reported which are ordinarily used to analyze the electromagnetic field of TE mode dielectric resonators based on a variation method or a mode matching method. In the $TE_{010}$ mode dielectric resonator 81 of the first embodiment, however, high-order $TE_{0n}$ modes (n: even number) occur at the inner surfaces of the electrodes 1 and 2 forming the circumferential ends of the openings 4 and 5, as described above. Therefore, it is difficult to use a variation method or a mode matching method for electromagnetic field analysis in the vicinity of the inner circumferential surfaces of the electrodes 1 and 2. For this reason, a finite element method was used for electromagnetic field analysis of the $TE_{010}$ mode dielectric resonator 81 of the first embodiment. Electromagnetic field analysis was made by using a two-dimensional finite element method suitable for electromagnetic field analysis of a device having a rotation symmetry structure in order to increase the calculation speed and calculation accuracy. This finite element method treats as unknown parameters the values of tangential components at an elemental boundary segment of the r-direction and z-direction components of the electric field expressed in the cylindrical coordinate system and the value of the ø-direction component at the elemental boundary segment of the electric field. This method is advantageous in that any spurious solution cannot easily be calculated and that the problem of an error due to a singularity of the electric field in the vicinity of the center axis can be avoided.

Figure 6A:
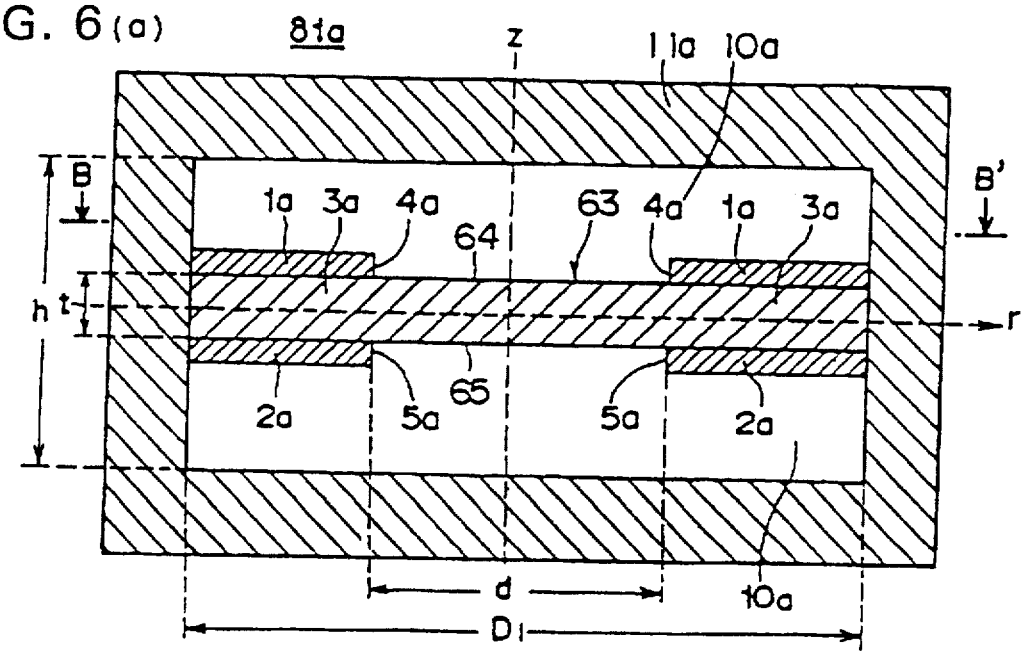
FIG. 6(*a*) is a longitudinal sectional view of a $TE_{010}$ mode dielectric resonator used as a model for analyzing the operation of the $TE_{010}$ mode dielectric resonator of the first embodiment.
Figure 6B:
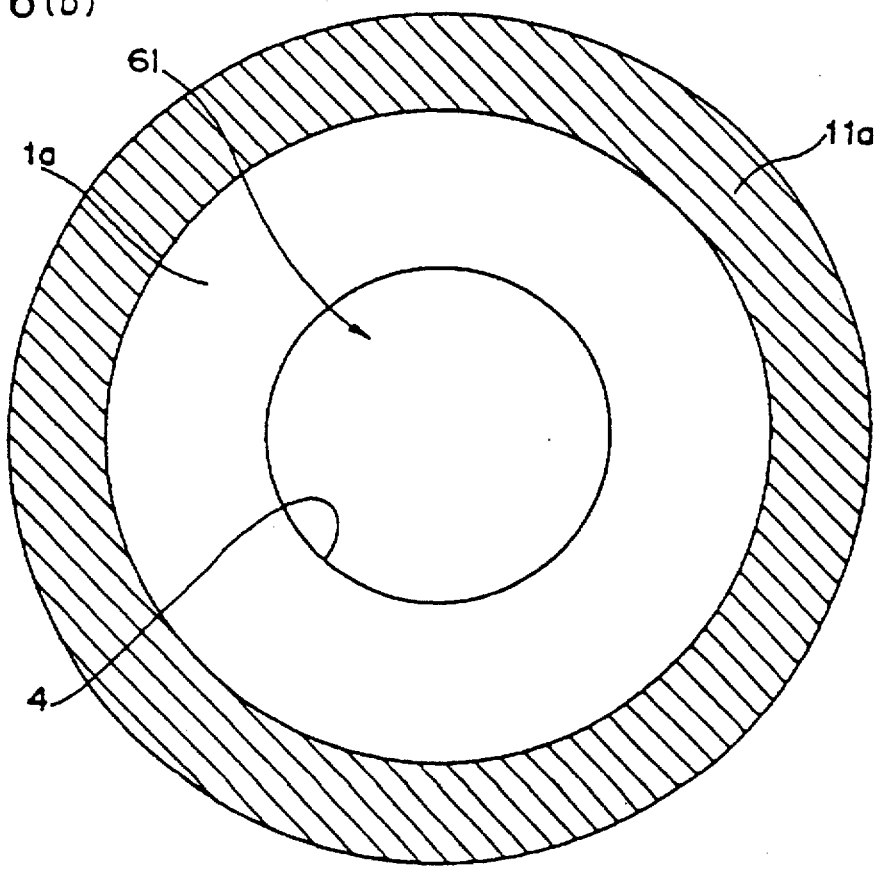

FIG. 6(*a*) is a longitudinal sectional view of a $TE_{010}$ mode dielectric resonator 81*a* which was used as a model for analyzing the electromagnetic field of the resonator 81 of the first embodiment. FIG. 6(*b*) is a cross-sectional view taken along the line B-B' of FIG. 6(*a*). The resonator 81*a* differs from the resonator 81 of the first embodiment in that a circular dielectric substrate 3*a* is used in place of the square dielectric substrate 3 of the first embodiment, and in that a conductor case 11*a* having a circular cross-sectional shape is used in place of the conductor case 11 having a square cross-sectional shape. An electrode 1*a* having an opening 4*a* and an electrode 2*a* having an opening 5*a* are respectively formed on the upper and lower surfaces of the dielectric substrate 3*a* to define a region 63 forming a resonator, as are the corresponding electrodes in the resonator 81 of the first embodiment. Also, the dielectric substrate 3*a* is provided in a cavity 10*a* formed in the conductor case 11*a*, as is the dielectric substrate 3 in the resonator 81 of the first embodiment. The dielectric substrate 3, the openings 4*a* and 5*a* and the cylindrical cavity 10*a* are disposed so as to share a common axis. The above-described two-dimensional finite element method can be used with respect to the $TE_{010}$ mode dielectric resonator 81*a*. If the diameter D1 of the cavity 10*a* is set to a predetermined value larger than the diameter d of the region 63, the region 60 of the resonator 81 and the region 63 of the resonator 81*a* have equal electromagnetic field distributions. Thus, the $TE_{010}$ mode dielectric resonator 81*a* can be used as a model for electromagnetic field analysis of the $TE_{010}$ mode dielectric resonator 81.

Referring to FIG. 6(*a*), the z-axis, which is an axis of rotation symmetry, coincides with the axis of the region 63, and a plane of z=0 was assumed to be a magnetic wall. A center point of the axis of the region 63 was assumed to correspond to z=0 of the z-axis. Structural parameters were set as shown below and the relation between the resonance frequency of the resonator 81*a* and the diameter d of the upper surface 64 and lower surface of the region 63 was calculated with respect to different values of the thickness t of the dielectric substrate 3*a*, i.e., 0.2 mm, 0.33 mm, and 0.5 mm to obtain the result shown in the graph of FIG. 31.

(1) (Dielectric constant $\epsilon_r$ of dielectric substrate 3*a*)=9.3

(2) (Height h of cavity 10*a*)=2.25 μm

Figure 31:
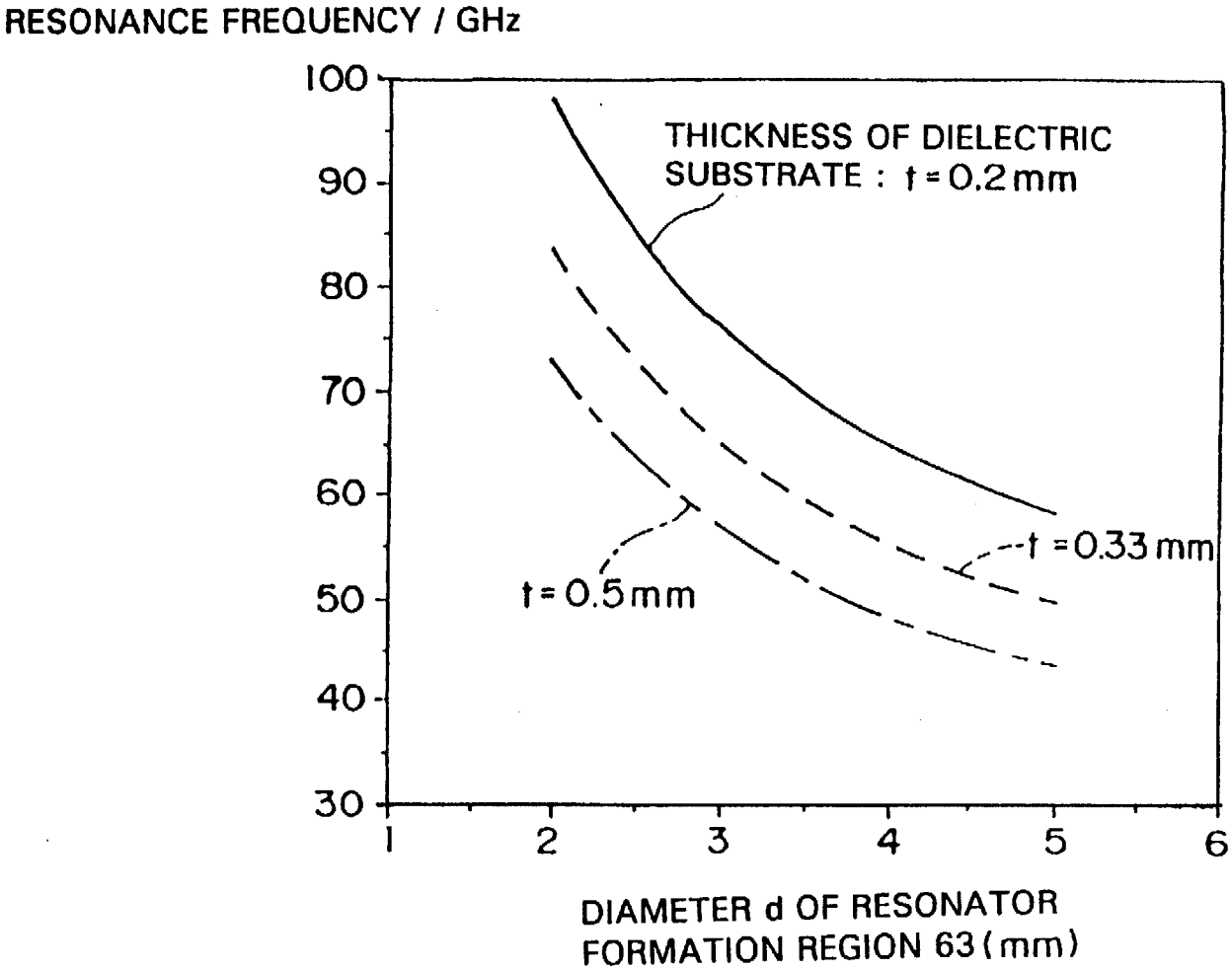
FIG. 31 is a graph showing the relationship between the resonance frequency and the diameter of a region of the $TE_{010}$ mode dielectric resonator of the first embodiment.

It can be clearly understood from FIG. 31 that the $TE_{010}$ mode dielectric resonator 81*a* resonates in the millimeter wave band from 40 to 100 GHz if the structural parameters are set as described above. It can also be understood that the resonance frequency becomes lower if the thickness t of the dielectric substrate 3*a* is increased while the diameter d of the upper end surface 64 of the region 63 is fixed, and that the resonance frequency becomes lower if the diameter d of the upper surface 64 of the region 63 is increased while the thickness t of the dielectric substrate 3*a* is fixed.

Figure 7:
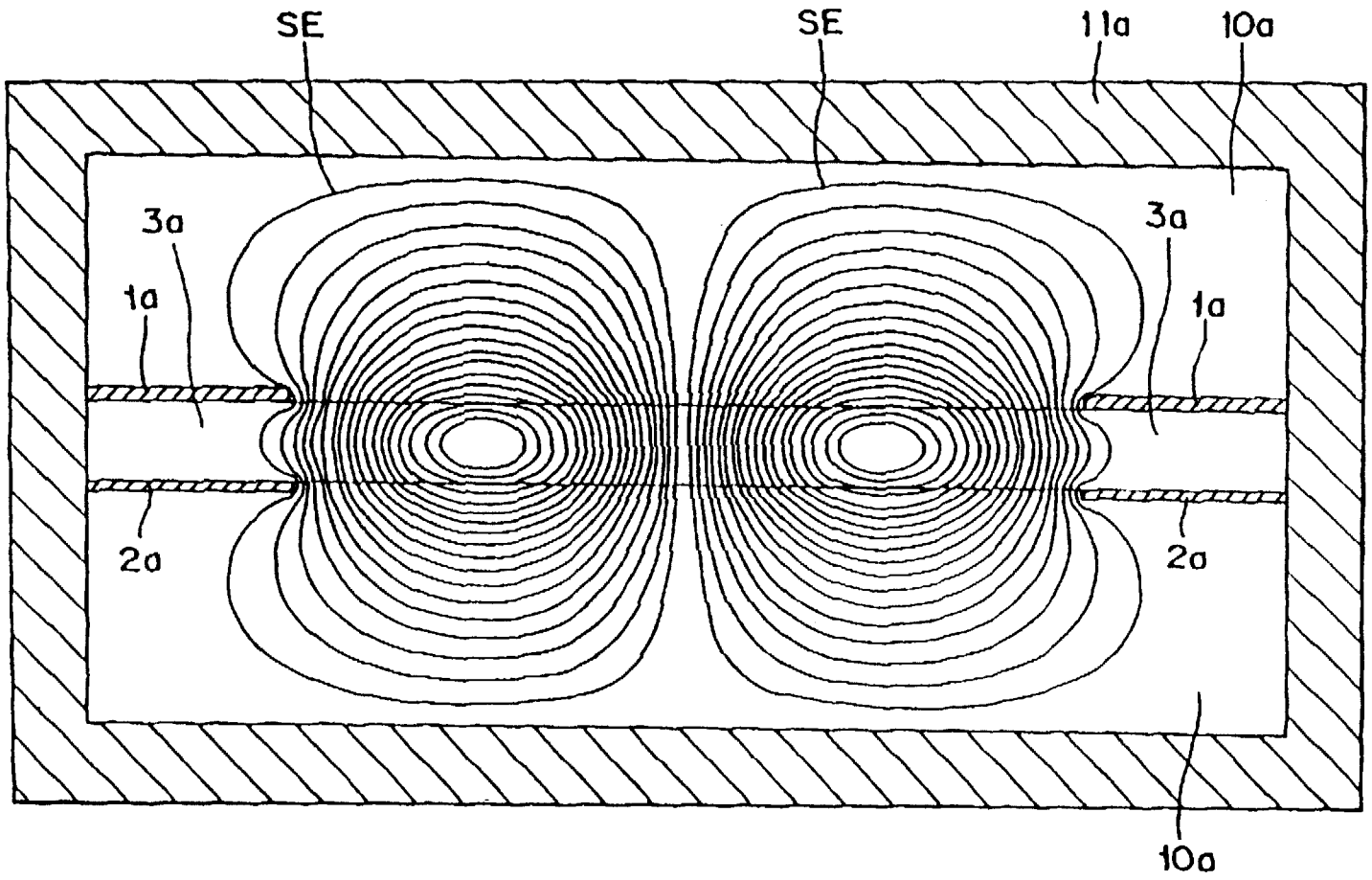
FIG. 7 is a longitudinal sectional view corresponding to FIG. 6(*a*) and showing an electric field strength distribution.
Figure 8:
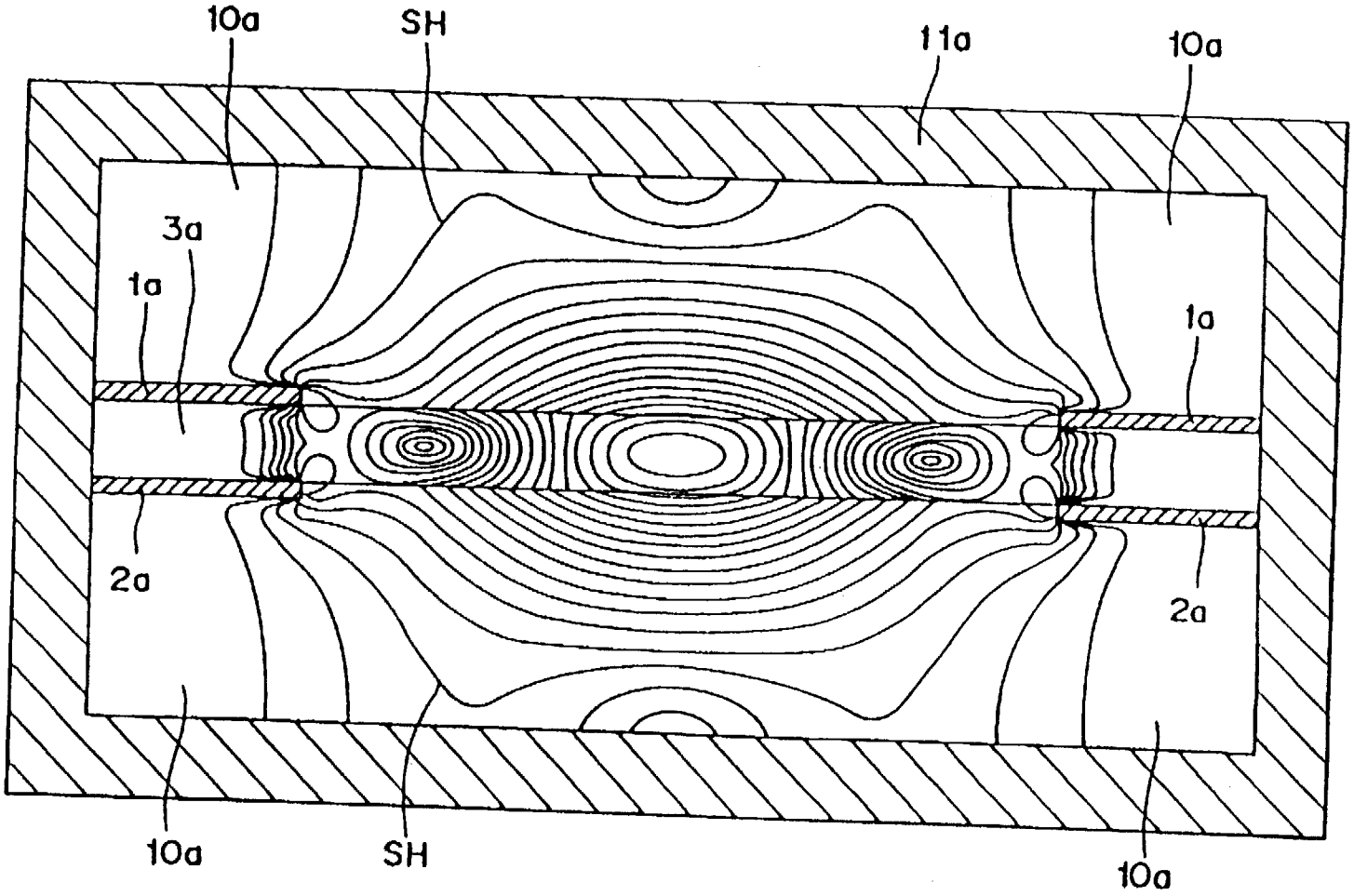
FIG. 8 is a longitudinal sectional view corresponding to FIG. 6(*a*) and showing a magnetic field strength distribution.

FIG. 7 shows a distribution of the strength of the electric field Eø when the structural parameters were set as described above. In FIG. 7, contour lines SE represent the distribution. Also, FIG. 8 shows a distribution of the strength of the magnetic field Hz represented by contour lines SH. As can be clearly understood from FIG. 7, the strength of the electric field is distributed in a toric form in the ø-direction. As can be clearly understood from FIG. 8, the z-component of the magnetic field is distributed so as to be maximized at the center of the resonator. These distributions are very similar to those in the electromagnetic distribution of the conventional $TE_{01\delta}$ mode dielectric resonator. However, it can be understood that electric energy and magnetic energy are concentrated more strongly inside the region 63 because the regions outside the region 63 have a cut-off effect much higher than that in the conventional $TE_{01\delta}$ mode dielectric resonator. Therefore, if this resonator is applied to a filter circuit, the interaction between circuit elements can be reduced and a circuit configuration having a higher integration density can therefore be expected.

Figure 9:
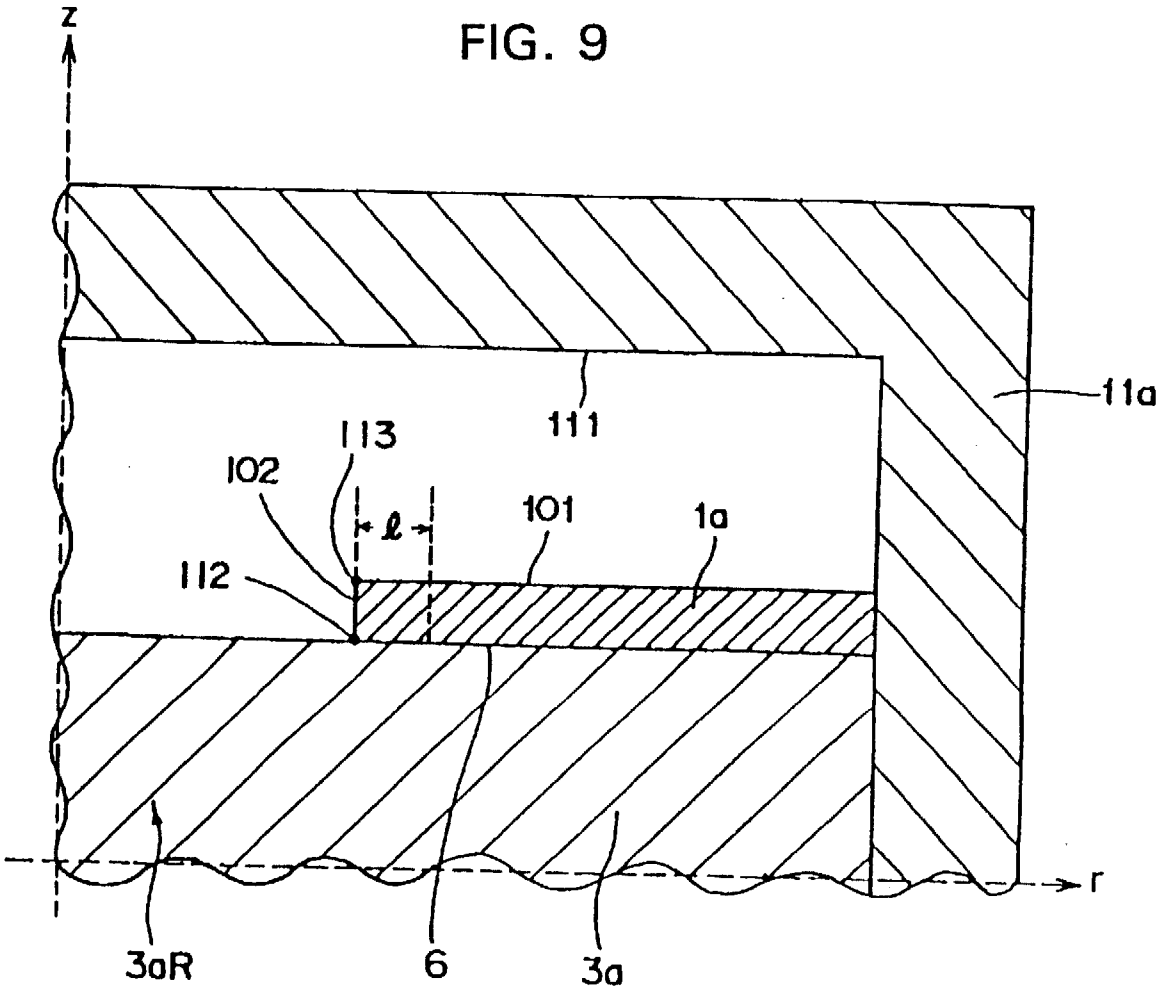
FIG. 9 is an enlarged longitudinal sectional view of a part of FIG. 6(*a*)

The result of analysis of a non-load Q of the $TE_{010}$ mode dielectric resonator 81*a* will next be described. In order to calculate the non-load Q of the resonator 81*a*, it is necessary to accurately calculate a conductor $Q_c$ due to a conductive loss at each of the surfaces of the electrodes 1*a* and 2*a* and the upper and conductor plates of the conductor case 11*a* shown in FIG. 9. Therefore, the conductor $Q_c$ was calculated by being separated into conductor $Q_c^{wall}$, $Q_c^{dia}$, $Q_c^{upp}$, and $Q_c^{low}$. The conductor $Q_c^{wall}$ is due to a conductive loss at the lower surface 111 of the upper conductor plate of the conductor case 11*a*. The conductor $Q_c^{dia}$ is due to a conductive loss at the inner circumferential side surface of the electrode 1*a* forming the opening 4*a*. The conductor $Q_c^{upp}$ is due to a conductive loss at the upper surface 101 of the electrode 1*a*, and the conductor $Q_c^{low}$ is due to a conductive loss at the lower surface 6 of the electrode 1*a*.

Ordinarily, the conductor $Q_c$ is given by an equation (10) shown below. The conductors $Q_c^{wall}$, $Q_c^{dia}$, $Q_c^{upp}$ and $Q_c^{low}$ are calculated by equation (10).

$$Q_c=(\omega\int_V|H|^2dV)/(R_s\int_s|H|^2ds) \quad (10)$$

First, the conductor $Q_c^{dia}$ is calculated. The thickness of the electrode 1*a* is set to a value on the submicron order and the magnetic field exhibits a markedly large value in the vicinity of the inner circumferential surface 102. At an electrode end, the magnetic field exhibits a more abrupt change. For this reason, it is very difficult to accurately calculate the magnetic field. Therefore, electromagnetic field was analyzed by using a simple computation model in which the thickness of the electrode 1*a* was zero. If the thickness of the electrode 1a was zero, the number of structural parameters can be reduced by one and the shape of meshes of the finite element method can be formed so as to be closer to equilateral triangles, whereby the accuracy of computation is improved.

According to the Kajfez perturbation theory, conductor $Q_c$ of a TE mode resonator having no vertical electric field to conductors can be calculated by an equation (11). In equation (11), $D_A$ is an attenuation parameter expressed by an equation (12). In these equations, d is the diameter of the region 63 and Rs is the surface resistance of the electrode 1*a*.

$$Q_c=\{(2\pi f_0\mu_0)/R_s\}\cdot(1/D_A) \quad (11)$$

$$D_A=\{2(-\partial f0/\partial d)\}/f_0 \quad (12)$$

The conductor $Q_c^{dia}$ was calculated on the basis of equations (11) and (12) by setting the structural parameters to the same values as those used in the resonance frequency calculation of FIG. 31 and by assuming that the material of the electrode 1*a* was aluminum having a conductivity $\sigma=3.7\times10^7$. The conductor $Q_c^{dia}$ thereby calculated was 8700.

Figure 10:
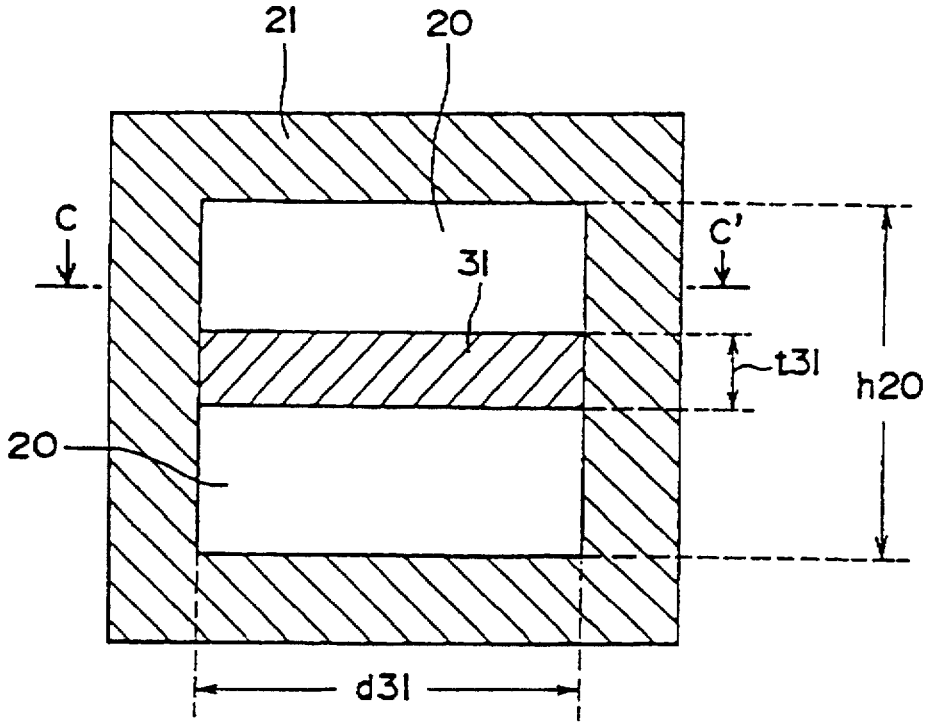
FIG. 10(*a*) is a longitudinal sectional view of a dielectric-loaded $TE_{011}$ mode resonator used for comparison with the present invention.
Figure 10:
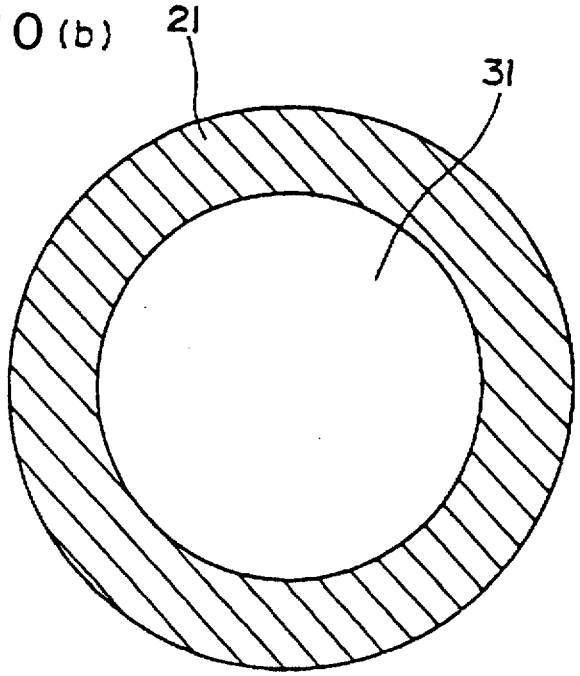

An examination described below was made to confirm that the result of calculation of the conductor $Q_c^{dia}$ performed as described above was substantially independent of the thickness of the electrode 1*a*. FIGS. 10(*a*) and 10(*b*) show a dielectric-loaded $TE_{011}$ mode resonator compared with the $TE_{010}$ mode dielectric resonator 81*a* of FIG. 6. FIG. 10(*a*) is a longitudinal sectional view of this dielectric-loaded $TE_{011}$ mode resonator and FIG. 10(*b*) is a cross-sectional view taken along the line C-C' of FIG. 10(*a*). The dielectric-loaded $TE_{011}$ mode resonator is constructed in such a manner that as shown in FIGS. 10(*a*) and 10(*b*) a cylindrical dielectric member 31 having a thickness t31 in the axial direction and an end surface having a diameter d31 is placed at a center of a cylindrical cavity 20 formed by a conductor case 21.

Structural parameters of the resonator 81*a* of FIG. 6 and the dielectric-loaded $TE_{011}$ mode resonator are set to values shown below, such that both the resonator 81*a* and the dielectric-loaded $TE_{011}$ mode resonator have the same resonance frequency of 63 GHz.

Figure 11:
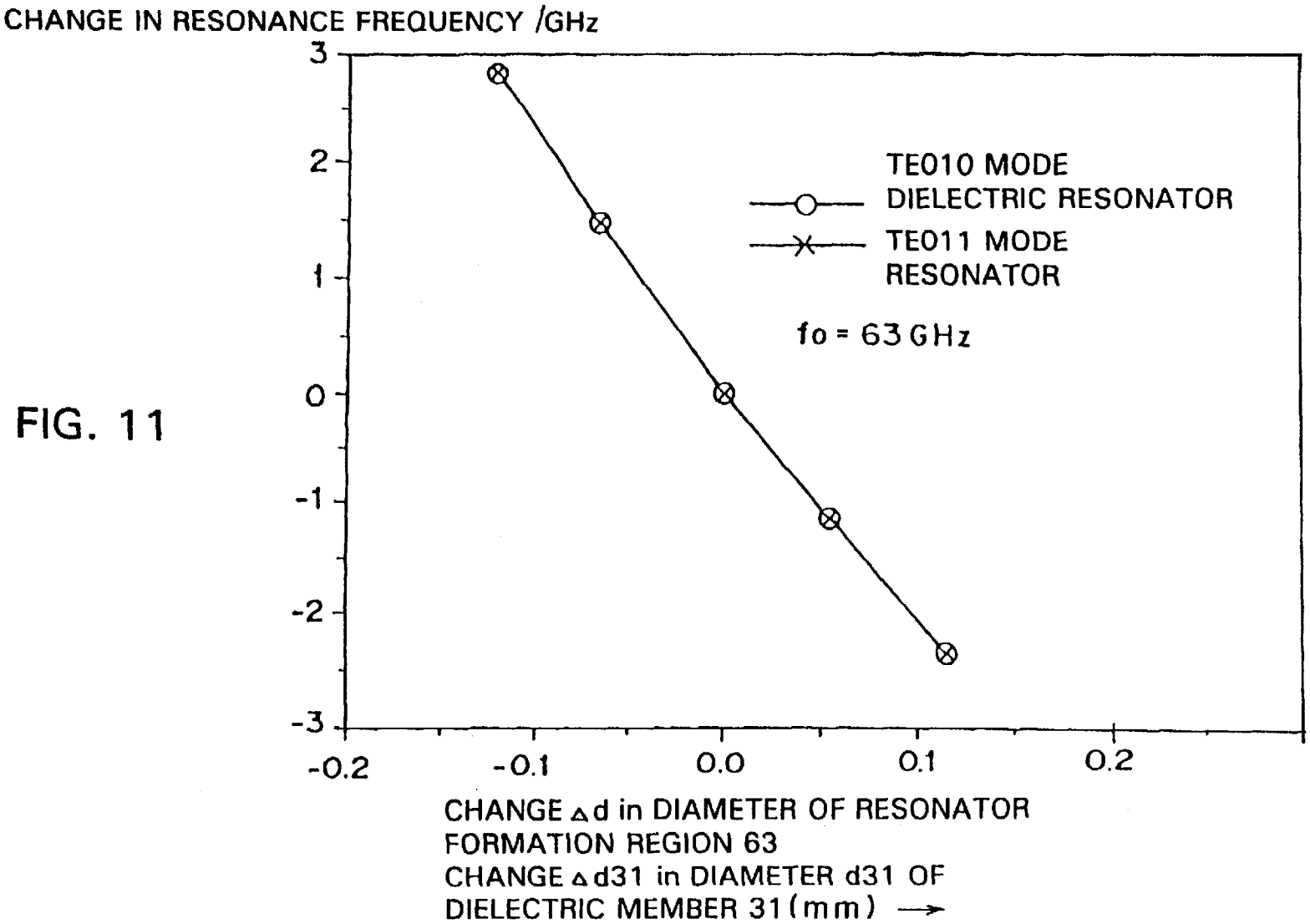
FIG. 11 is a graph showing the relationship between the change in resonance frequency and changes in the diameter of an opening and the diameter of a dielectric member.

1. Set values of the structural parameters of the $TE_{010}$ mode dielectric resonator 81*a*:
   (1) (Diameter d of region 63)=3.26 mm,
   (2) (Height h of cavity 10*a*)=2.25 mm,
   (3) (Dielectric constant ∈r of dielectric substrate 3*a*)=9.3
   (4) (Thickness t of dielectric substrate 3*a*)=0.33 mm
2. Set values of the structural parameters of the dielectric-loaded $TE_{011}$ mode resonator:
   (1) (Diameter d31 of dielectric member 31)=3.49 mm,
   (2) (Height h31 of cavity 20)=2.25 mm,
   (3) (Dielectric constant ∈r of dielectric member 31)=9.3
   (4) (Thickness t31 of dielectric member 31)=0.33 mm The diameter d of the region 63 and the diameter d31 of the dielectric member 31 in the $TE_{010}$ mode dielectric resonator 81*a* and the dielectric-loaded $TE_{011}$ mode resonator having the structural parameters set shown above were changed and the changes in the resonance frequencies with respect to changes Δd and Δd31 in these diameters were calculated. The result of this calculation is shown in the graph of FIG. 11. As shown in FIG. 11, the resonance frequency of each of the $TE_{010}$ mode dielectric resonator 81*a* and the dielectric-loaded $TE_{011}$ mode resonator changed in proportion to the change Δd or Δd31 in diameter d or d31 and became lower when the diameter d or d31 was increased. There is a substantially linear relationship between the resonance frequency and the amount of the diameter's variation. According to the perturbation theory, the inclination determines the conductor $Q_c$. The result was that the conductor $Q_c$ of the $TE_{010}$ mode dielectric resonator 81*a* was 8800 while the conductor $Q_c$ of the dielectric-loaded $TE_{011}$ mode resonator was 8700, that is, it was confirmed that these resonators had substantially the same conductor $Q_c$.

The surface area of the inner surface 120 of the electrode 1*a* forming the circumferential end of the opening 4*a* in the $TE_{010}$ mode dielectric resonator 81*a* is extremely small in comparison with the surface area of the side surface of the cavity 20 of the dielectric-loaded $TE_{011}$ mode resonator; nevertheless, the resonator 81*a* and the dielectric-loaded $TE_{011}$ mode resonator have substantially the same conductor $Q_c$, as described above. From this fact, it can be understood that a model in which the thickness of the electrode 1*a* is zero is effective as a very close approximation. It is also supposed that the conductor $Q_c^{dia}$ represents an essential Q with respect to the fundamental resonance mode $TE_{010}$.

The $Q_c^{wall}$ was also calculated by the same perturbation method. The calculated conductor $Q_c^{wall}$ was 25400.

Next, the conductor $Q_c^{upp}$ and the conductor $Q_c^{low}$ are calculated. In analysis of these factors, the magnetic field cannot be calculated accurately in the vicinity of the electrode ends 112 and 113 (FIG. 9) because it has extremely large values in the vicinity of these ends, as in the case of the calculation of the conductor $Q_c^{dia}$. While as mentioned above the conductor $Q_c^{dia}$ is an essential conductor Q with respect to the fundamental resonance mode $TE_{010}$, the conductor $Q_c^{upp}$ and the conductor $Q_c^{low}$ are due to current loss caused by the magnetic field of evanescent waves in high-order $TE_{0'2n+1}$ modes coupling with the resonating electromagnetic field in the $TE_{010}$ mode, and it is difficult to find a method for accurately calculating the conductor $Q_c^{upp}$ and the conductor $Q_c^{low}$ from the result of calculation by the perturbation method. Therefore, the conductor $Q_c^{upp}$ and the conductor $Q_c^{low}$ were calculated by using the magnetic field of evanescent waves in high-order $TE_{0'2n+1}$ modes, as described below.

Figure 12:
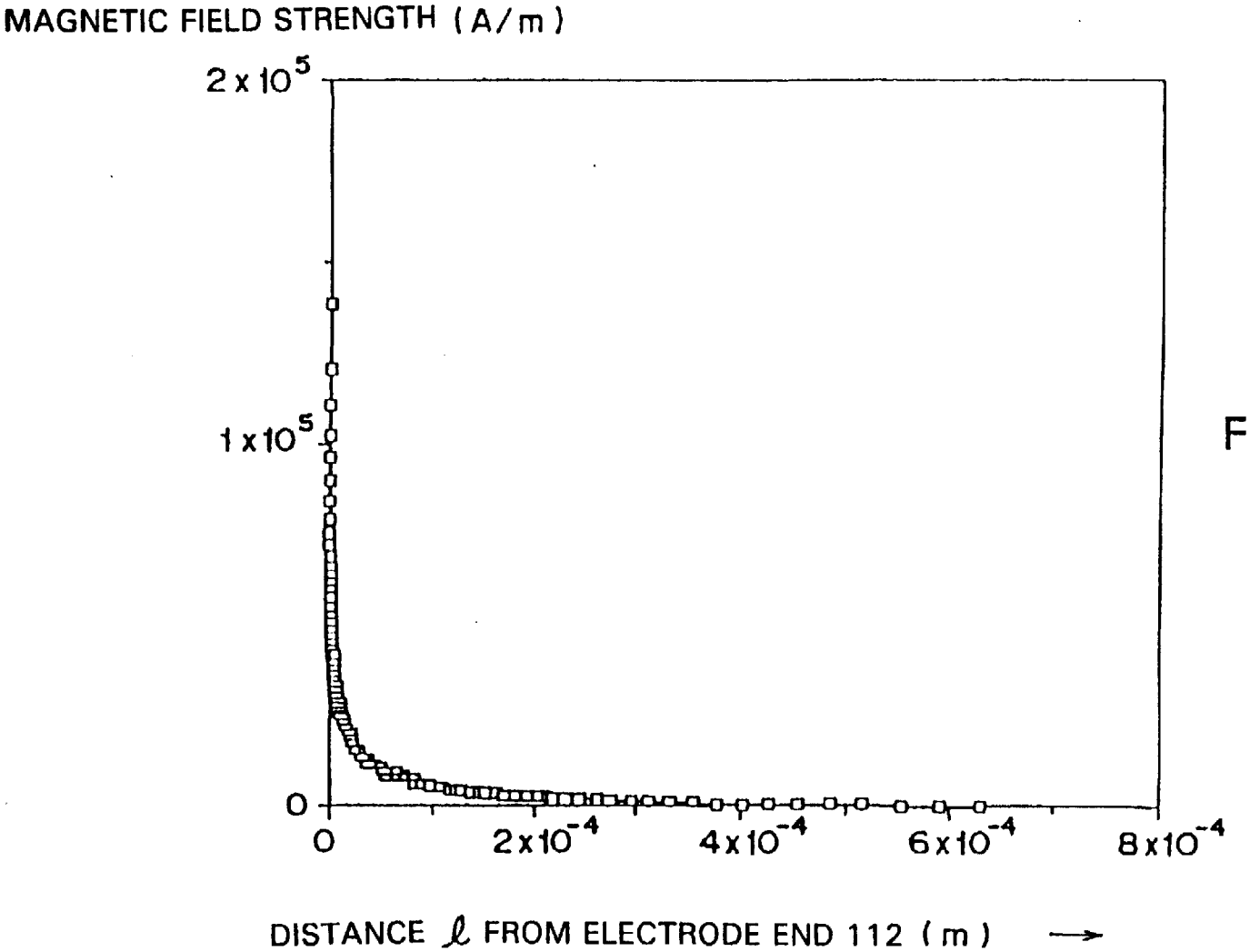
FIG. 12 is a graph of the magnetic field strength at the distance 1 from an electrode end.
Figure 13:
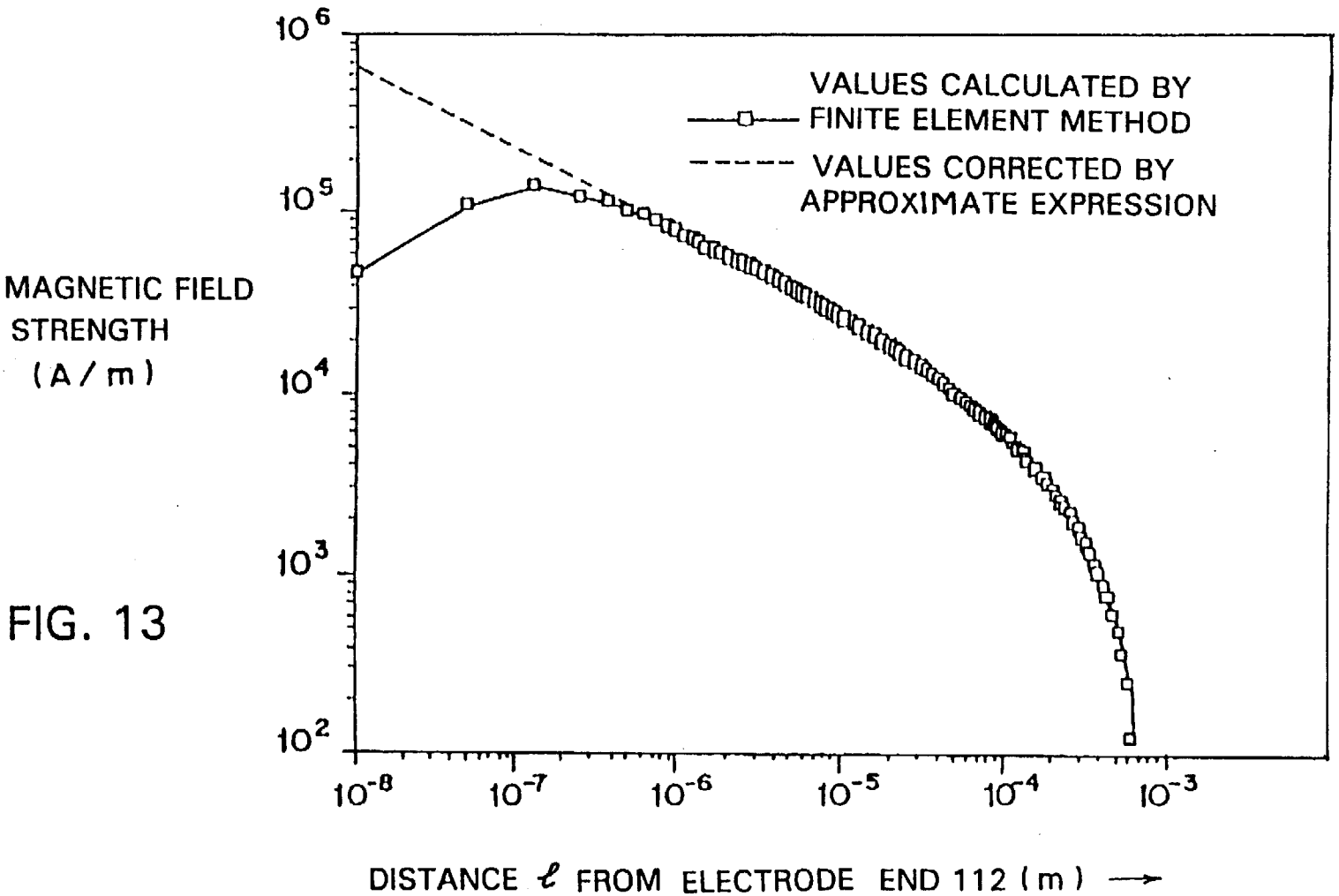
FIG. 13 is a graph relating to FIG. 12 and showing the magnetic field strength at the distance 1 from an electrode end when the distance 1 is small.

First, the result of analysis of a magnetic field strength distribution was evaluated. FIG. 12 is a graph showing the magnetic field strength in the vicinity of the electrode end 112 of the lower surface 6 of the electrode 1*a*, i.e., at points spaced apart by distance l from the electrode end 112 (FIG. 9), calculated by the finite element method. As is apparent from FIG. 12, a divergence of the magnetic field strength occurs at the electrode end 112, that is, when l=0. FIG. 13 is a graph in which both the magnetic field strength and the distance l are shown on logarithmic scales to grasp the magnetic field distribution at a position very close to the electrode end 112 in the vicinity of the same. It is apparent from FIG. 13 that the magnetic field density cannot be calculated accurately by the finite element method when the distance from the electrode end 112 is 1 μm or less. Accordingly, the conductor $Q_c$ can not be calculated directly from this magnetic field strength. Therefore, the magnetic field H of evanescent waves in $TE_{0'2n+1}^{+}$ modes was expressed by an equation (13) shown below by correcting the magnetic field strength with respect to the distance l of 1 μm or less on the assumption that since the magnetic field strength changes linearly in the range of distance l from 1 to 10 μm, it also changes linearly with the same inclination in the range of 1 μm or less. Then, the conductor $Q_c$ was expressed by an equation (14) shown below by using equation 13. In equation 13, K is a constant. Integration of $\int_0^{10\ \mu m} 2\pi r[Kl^{-\alpha}]^2 dl$ is performed in the range from l=0 to l=10 μm.

$$H=Kl^{-\alpha} \tag{13}$$

where $0 \leqq l \leqq 10$ μm.

$$\begin{aligned} Q_c &= (\omega \int V|H|^2 dV)/(R_s \int_S |H|^2 ds) \\ &= (\omega \int V|H|^2 dV)/(R_s \int_0^{10\mu m} 2\pi r[Kl^{-\alpha}]^2 dl) \end{aligned} \tag{14}$$

From FIG. 12, the following values of constants K and α were obtained. At the upper surface 101 of the electrode 1*a*, the value of constant K was $10^{3.683}$ and the value of constant α was −0.4180. At the lower surface 6 of the electrode 1*a*, the value of constant K was $10^{3.518}$ and the value of constant α was −0.4608. The conductor $Q_c^{upp}$ and the conductor $Q_c^{low}$ were calculated by substituting these values of constants K and α in equation (14), thereby obtaining 4700 and 5300. The conductor $Q_c^{total}$ obtained by combining the conductor losses at the surfaces of the electrodes 1*a* and 2*a* and the upper and lower conductor plates of the conductor case calculated as described above was 1800 in the case of forming the electrode 1*a* of aluminum. Table 1 shows the result of the above-described calculation along with the result of calculation in the case of forming the electrode 1*a* of silver.

TABLE 1

The result of calculation of conductor $Q_c$ (when the resonance frequency was set to 63 GHz)

| | Calculation Method | Aluminum Electrode | Silver Electrode |
|---|---|---|---|
| $Q_c^{dia}$ | Perturbation Method | 8700 | 11230 |
| $Q_c^{wall}$ | Perturbation Method | 25400 | 45220 |
| $Q_c^{upp}$ | Integration Method (Correction at Electrode End 112) | 4700 | 6070 |
| $Q_c^{low}$ | Integration Method (Correction at Electrode End 112) | 5300 | 6840 |
| $Q_c^{total}$ | | 1800 | 2400 |

Figure 14:
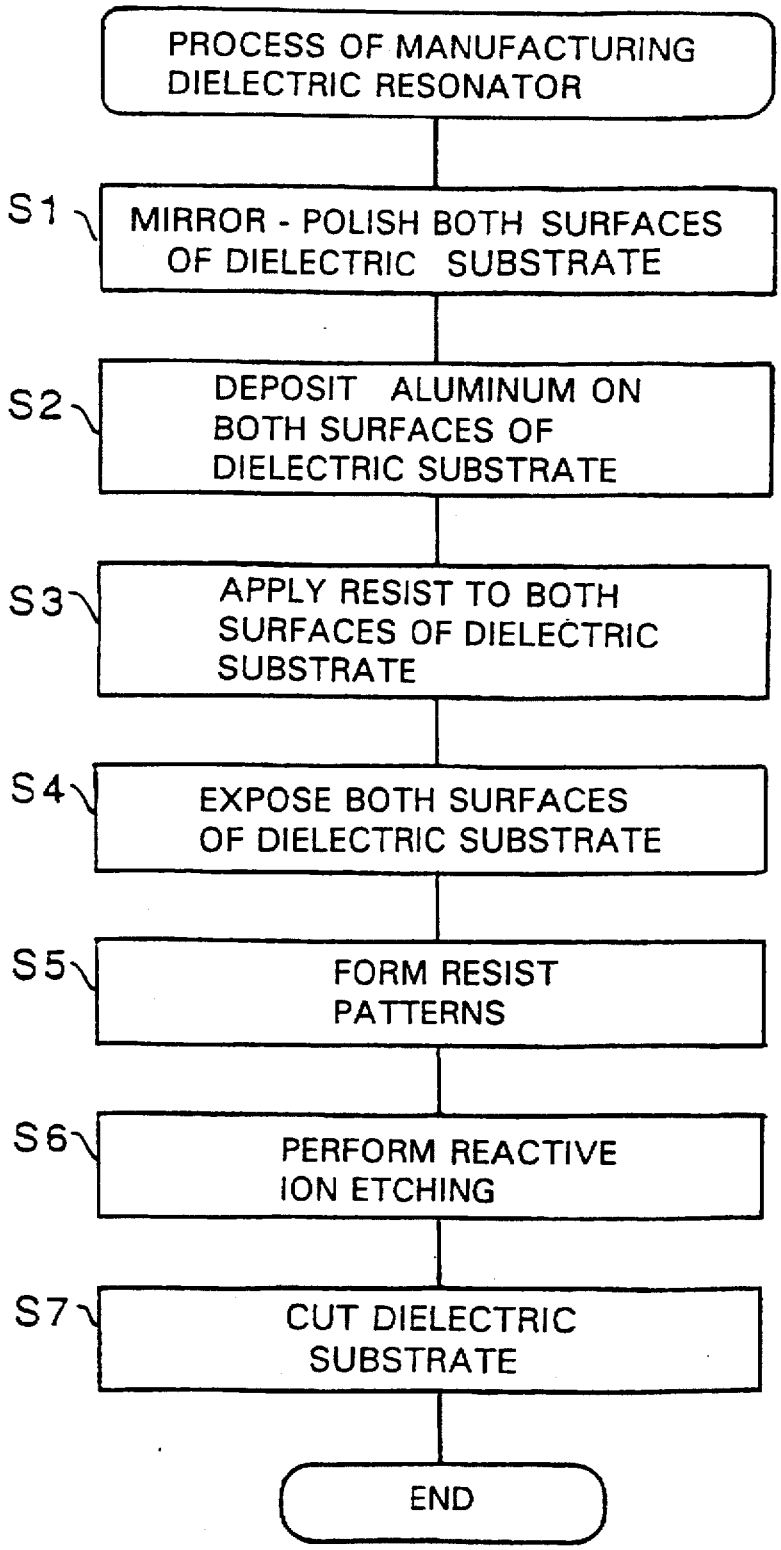
FIG. 14 is a flowchart schematically showing the process of manufacturing the $TE_{010}$ mode dielectric resonator of the first embodiment.

The inventors actually manufactured the $TE_{010}$ mode dielectric resonator 81 in accordance with the first embodiment of the present invention and measured the resonance frequency and the non-load Q of the resonator. FIG. 14 is a flowchart of the process of manufacturing the $TE_{010}$ mode dielectric resonator 81. A monocrystal sapphire substrate was used as dielectric substrate 3. The monocrystal sapphire substrate was formed by being cut so as to have upper end lower surfaces corresponding to the C-plane, that is, perpendicular to the C-axis, and so that the thickness t was 0.33 mm. The dielectric constant of the monocrystal sapphire substrate in the direction perpendicular to the C-plane is 9.3.

In Step 1, both surfaces of a dielectric substrate 3 are polished to be mirror-finished. In Step 2, aluminum is deposited to a thickness of 0.6 μm over the entire areas of the two surfaces of the dielectric substrate. In Step 3, a resist is applied to both surfaces of the dielectric substrate. In Step 4, both layers of the applied resist are exposed by a two-sided exposing device. In Step 5, the resist is removed at the position corresponding to region 60 of each dielectric substrate 3 to form a resist pattern. In Step 6, reactive ion etching, which is a kind of dry etching, is performed to remove aluminum in the area corresponding to the region 60. The resist on electrodes 1 and 2 is then removed. Thereafter, in Step 7, the dielectric substrate is cut at predetermined positions to make dielectric substrates 3 with electrodes 1 and 2 formed on the dielectric substrates 3. Reactive ion etching performed in Step 6, in contrast with ordinary dry etching, enables the inner circumferential surfaces of the electrodes 1 and 2 forming the openings 4 and 5 to be worked so as to be approximately vertical to the surfaces of the dielectric substrate 3. Measured values of the non-load Q closer to corresponding calculated values can be obtained thereby. The inner circumferential surfaces of the electrodes 1 and 2 were formed so that the diameter d of the upper end surface 61 and the lower end surface 62 of the region 60 of the $TE_{010}$ mode dielectric resonator 81, i.e., the diameter d of the openings 4 and 5, was 3.26 mm.

Figure 15:
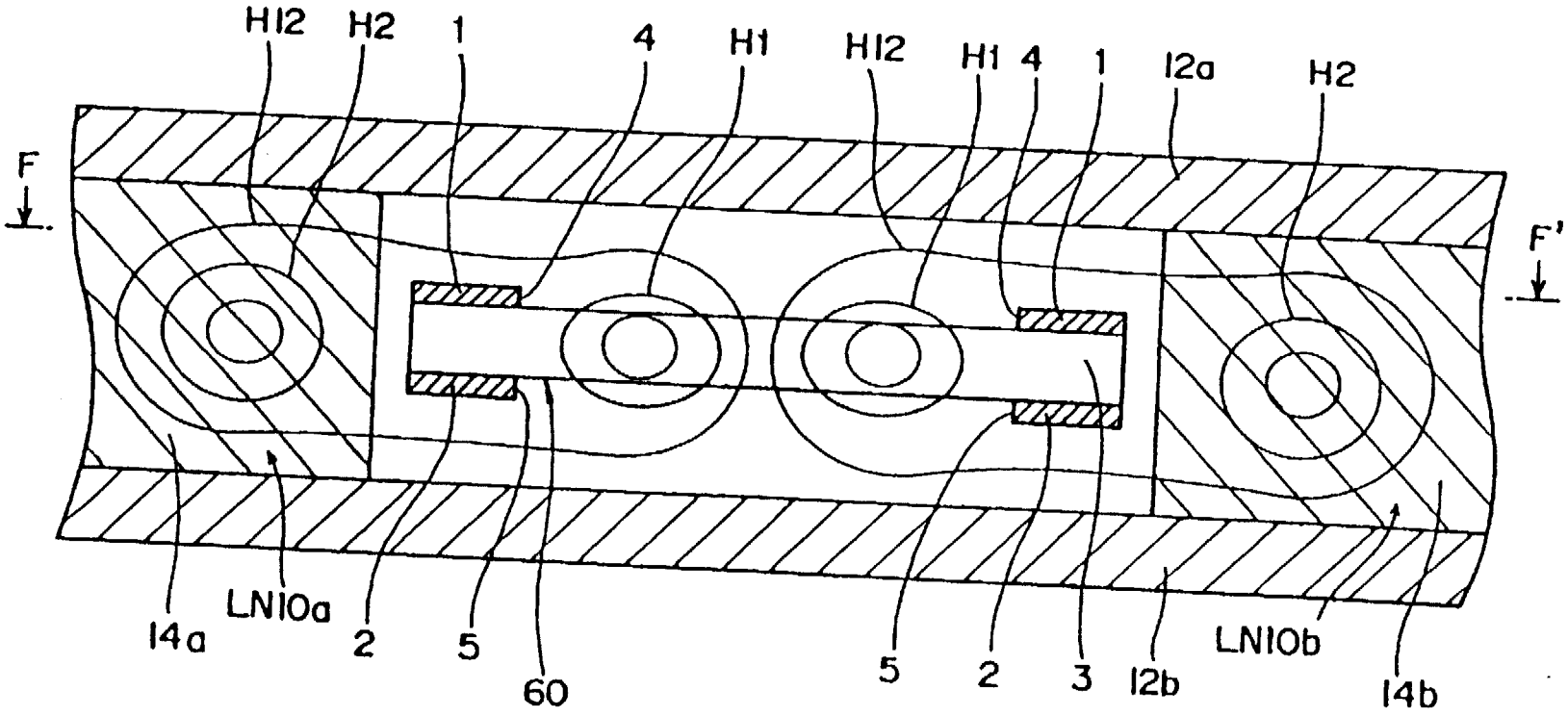
FIG. 15 is a longitudinal sectional view of a resonator measuring jig used to measure the $TE_{010}$ mode dielectric resonator of the first embodiment.
Figure 16:
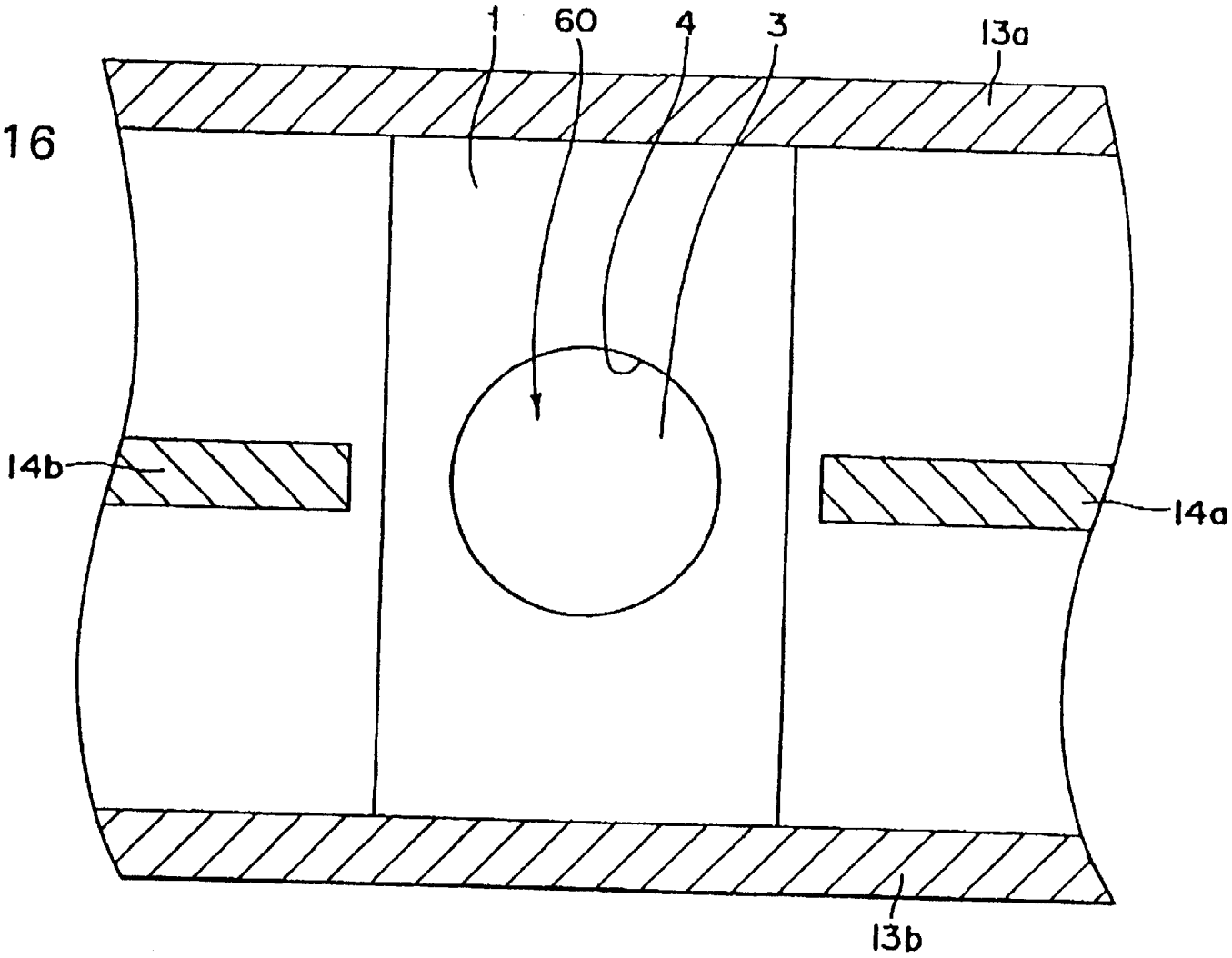
FIG. 16 is a cross-sectional view taken along the line F-F' of FIG. 15.

The resonance frequency and the non-load Q of the $TE_{010}$ mode dielectric resonator 81 manufactured by the above-described manufacturing process were measured. FIG. 15 is a longitudinal sectional view of a resonator measuring jig, and FIG. 16 is a cross-sectional view taken along the line F-F' of FIG. 15. The resonator measuring jig is formed of a rectangular waveguide having an upper conductor plate 12*a*, a lower conductor plate 12*b* and side conductor plates 13*a* and 13*b* (FIG. 16). In this rectangular waveguide, a pair of dielectric members 14*a* and 14*b* in the form of rectangular prisms are disposed at a center of the rectangular waveguide in the widthwise direction so that one end surface of the dielectric member 14*a* and one end surface of the dielectric member 14*b* face each other with a predetermined spacing set therebetween. Each of the dielectric members 14*a* and 14*b* is disposed so that its longitudinal axis is parallel to the longitudinal direction of the waveguide 12, and so that its upper surface contacts the lower surface of the upper conductor plate 12*a* while its lower surface contacts the upper surface of the lower conductor plate 12*b*. The distance between the conductor plates 12*a* and 12*b* is 2.25 mm. Thus, an input NRD guide LN10*a* for inputting a high-frequency signal to the $TE_{010}$ mode dielectric resonator 81 and an output NRD guide LN10*b* for outputting a high-frequency signal from the $TE_{010}$ mode dielectric resonator 81 are formed. An HP8510C network analyzer (not shown) was used as a measuring apparatus, WR-15 waveguides were used as input and output waveguides and a conversion horn was used for conversion between the $TE_{01}$ mode of the waveguides and the LSM mode of the NRD guides.

The manufactured dielectric substrate 3 is placed between the input NRD guide LN10*a* and the output NRD guide LN10*b* of the resonator measuring jig so as to be parallel to the upper and lower guide plates 12*a* and 12*b* while being spaced apart therefrom by equal distances. The distance between one surface of the input NRD guide 10*a* and one surface of the output NRD guide 10*b* facing each other is set to such a value that the side surfaces of the dielectric substrate 3 at the opposite ends in the longitudinal direction are close to the end surfaces of the dielectric members 14*a* and 14*b*. Thus, the $TE_{010}$ mode dielectric resonator 81 is constructed between the above-described input NRD guide LN10*a* and output NRD guide LN10*b* of the resonator measuring jig.

In the resonator measuring jig and the $TE_{010}$ mode dielectric resonator 81, the input NRD guide LN10*a* and the output NRD guide LN10*b* couple with the $TE_{010}$ mode dielectric resonator 81 by inductive coupling, thus making it possible to measure the resonance frequency and non-load Q of the $TE_{010}$ mode dielectric resonator 81. Referring to FIG. 15, H1 is a magnetic field of the resonator 81 while H2 are magnetic fields of the input NRD guide LN10*a* and the output NRD guide LN10*b*. H12 are magnetic fields formed by coupling between the $TE_{010}$ mode dielectric resonator 81 and the input NRD guide LN10*a*, and coupling between the resonator 81 and the output NRD guide LN10*b*.

Figure 17:
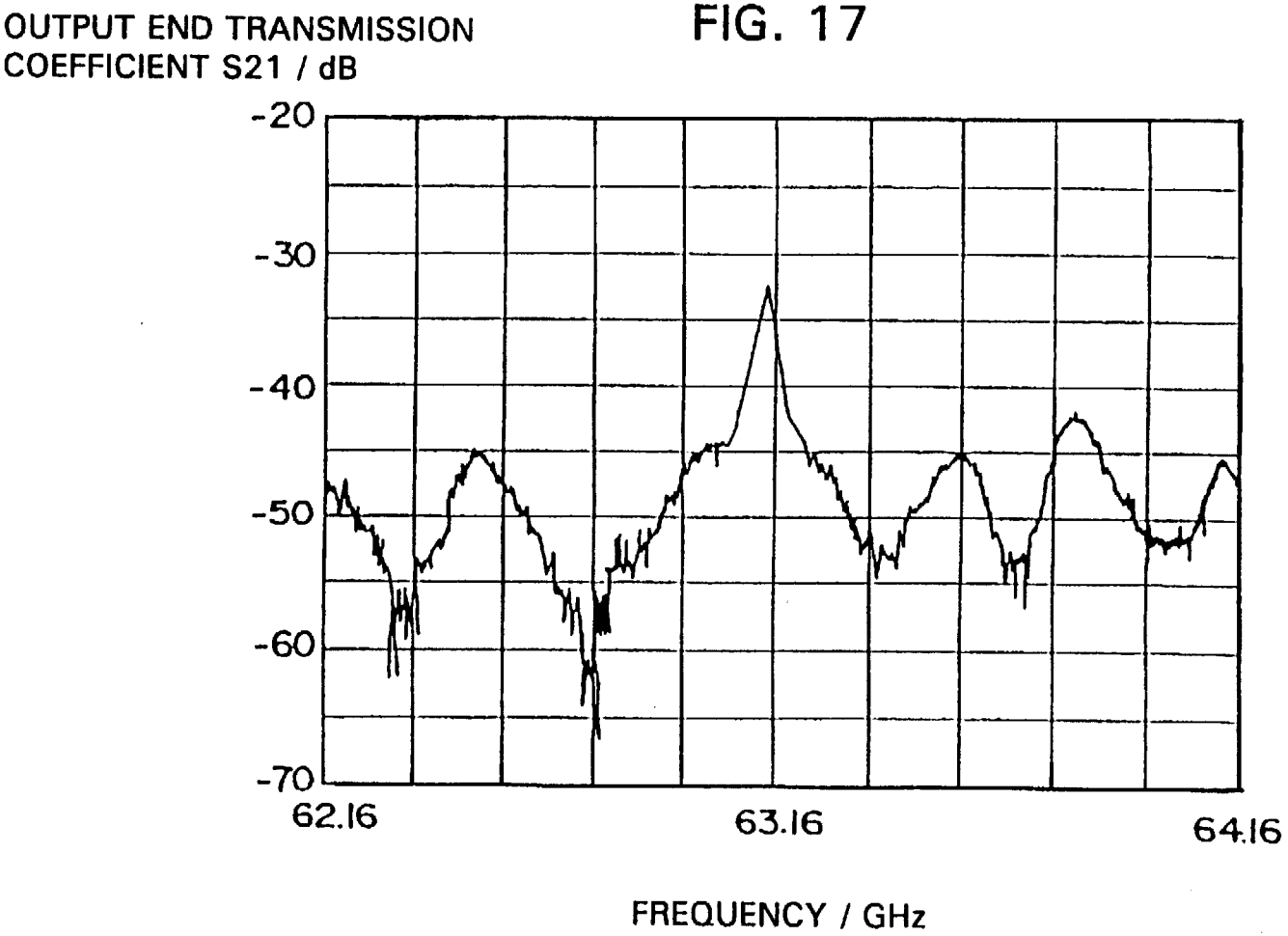
FIG. 17 is a graph showing output end transmission coefficient $S_{21}$ of the $TE_{010}$ mode dielectric resonator of the first embodiment about the resonance frequency.

FIG. 17 shows a resonance characteristic obtained by this measurement. In FIG. 17, an output end transmission coefficient $S_{21}$ is indicated with respect to the frequency. According to FIG. 17, the resonance frequency is determined to be 63.1 GHz. This value is approximately equal to one calculated by the finite element method, i.e., 63.0 GHz. As the non-load Q, a value of 1610 was actually measured. On the other hand, if dielectric Qd due to the conductive loss in the sapphire substrate is 20000, the calculated value of the non-load Q is 1660. Thus, a significant match is recognized between the measured values and the calculated values. Also, resonance in high-order modes is suppressed by the effect of the structure, which is symmetrical about the longitudinal and lateral directions.

A temperature characteristic of the resonance frequency of the $TE_{010}$ mode dielectric resonator 81 in accordance with the present invention will next be described. As mentioned above, the resonator 81 has a larger amount of electromagnetic energy concentrated in the region 60 in comparison with the conventional $TE_{01\delta}$ mode dielectric resonator. Moreover, the change in the diameter d of the region 60 with respect to temperature coincides with the change in the size of the dielectric substrate 3 in accordance with the linear expansion coefficient $\alpha_d$ of the same because the electrodes 1 and 2 of the resonator 81 expand and contract in accordance with the linear expansion coefficient $\alpha_d$ of the dielectric substrate 3. Therefore, further improved stability with respect to temperature can be expected.

Figure 18:
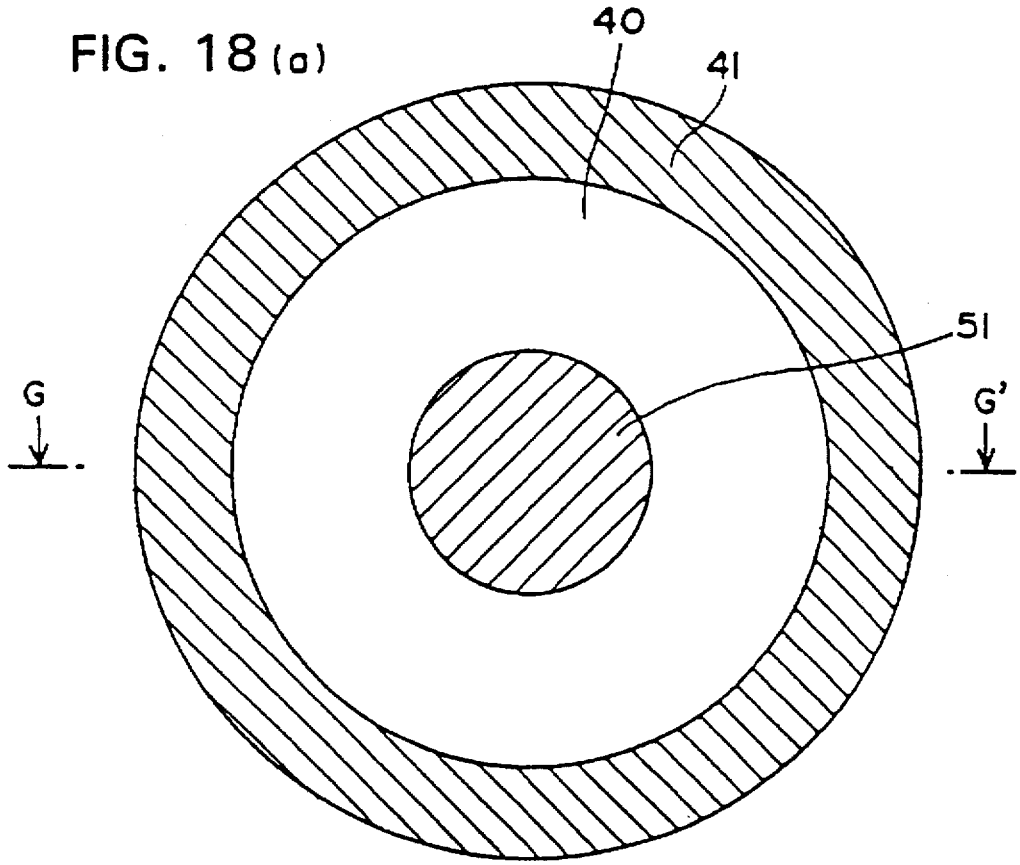
FIG. 18(*a*) is a cross-sectional view of a $TE_{018}$ mode dielectric resonator used for comparison with the present invention.
Figure 18:
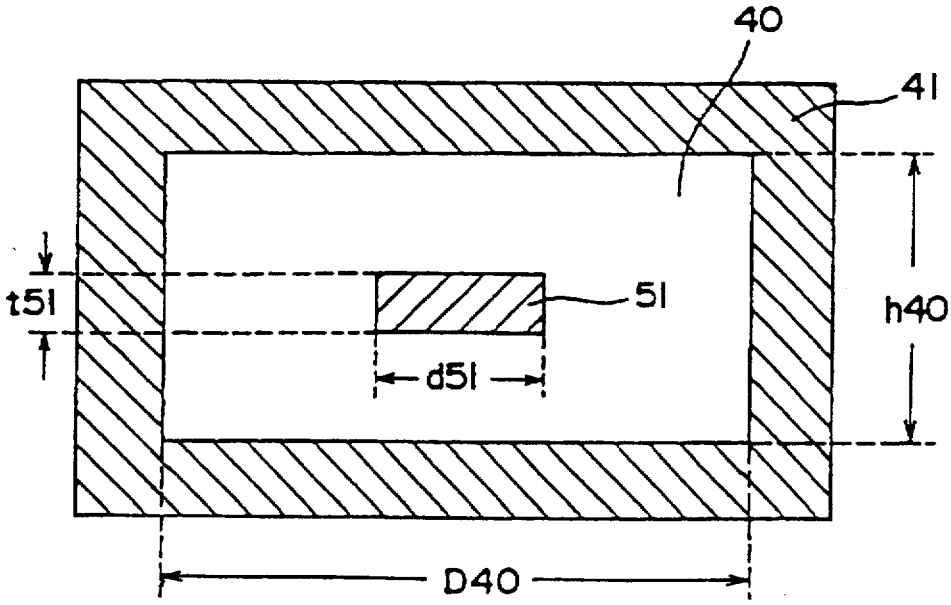

First, a temperature characteristic of the resonator 81 and that of the resonance frequency of a $TE_{01\delta}$ mode dielectric resonator will be compared by calculation. FIGS. 18(*a*) and 18(*b*) show a $TE_{01\delta}$ mode dielectric resonator for comparison with the $TE_{010}$ mode dielectric resonator 81 of the present invention. FIG. 18(*a*) is a cross-sectional view of the $TE_{01\delta}$ mode dielectric resonator and FIG. 18(*b*) is a longitudinal sectional view taken long the line G-G' of FIG. 18(*a*). As shown in FIGS. 18(*a*) and 18(*b*), the $TE_{01\delta}$ mode dielectric resonator is constructed in such a manner that a cylindrical dielectric member 51 is provided at a center of a cylindrical cavity 40 formed in a conductor case 41 having upper and lower surfaces. The dielectric member 51 has a diameter d51 and a thickness t51 in the axial direction. The cavity 40 has a diameter D40 and a height h40.

For ease of calculation in the following description it is assumed that the axial center of the dielectric member 51 and the axis of the cavity 40 of the $TE_{01\delta}$ mode dielectric resonator are always in alignment with each other even if the temperature thereof changes. Then each of a temperature characteristic $\eta f$ of the resonance frequency of the $TE_{010}$ mode dielectric resonator 81 and a temperature characteristic $\eta f$ of the resonance frequency of the $TE_{01\delta}$ mode dielectric resonator is expressed by a general formula shown below. The temperature characteristic $\eta f$ is defined as a value obtained by dividing the change in the resonance frequency with respect to a change of 1° C. in temperature by the resonance frequency.

$$\eta f = -A(\eta_e/2) - B\alpha_d - C\alpha_m \quad (15)$$

where $\eta_e$ is a temperature coefficient of the dielectric constant of the dielectric substrate 3 or the dielectric member 51; $\alpha_d$ is a linear expansion coefficient of the dielectric substrate 3 or the dielectric member 51; $\alpha_m$ is a linear expansion coefficient of the conductor used to form the conductor case 11 or 41; A is the ratio of an amount of electric energy accumulated in the region 60 or the dielectric member 51 to the total amount of accumulated energy; B is a proportional constant of the linear expansion coefficient of the dielectric substrate 3 or the dielectric member 51 with respect to the temperature characteristic $\eta_f$ of the resonance frequency; and C is a proportional constant of the linear expansion coefficient of the conductor of the conductor case 11 or 41 with respect to the temperature characteristic $\eta_f$ of the resonance frequency. The proportional constants A, B and C can be obtained by eigenvalue calculation based on the finite element method. These constants are substituted in equation (15) to express the temperature characteristic $\eta_f^{TE010}$ of the resonance frequency of the $TE_{010}$ mode dielectric resonator and the temperature characteristic $\eta_f^{TE01\delta}$ of the resonance frequency of the $TE_{01\delta}$ mode dielectric resonator by the following equations (16) and (17), respectively.

$$\eta_f^{TE010}=-0.869((\eta_e/2)-0.910\alpha_d-0.0735\alpha_m \quad (16)$$

$$\eta_f^{TE01\delta}=-0.747((\eta_e/2)-0.785\alpha_d-0.209\alpha_m \quad (17)$$

As is apparent from equations (16) and (17), proportional constant B=0.0735 in the temperature characteristic $\eta_f^{TE010}$ of the resonator 81 is extremely small in comparison with proportional constant B=0.209 in the temperature characteristic $\eta_f^{TE01\delta}$ of the resonance frequency of the $TE_{01\delta}$ a mode dielectric resonator. From this relation, it can be understood that the temperature characteristic $\eta_f^{TE010}$ of the resonance frequency of the resonator 81 is much less affectable by the linear expansion coefficient of the conductor of the conductor case 11 or 41 than the temperature characteristic $\eta_f^{TE01\delta}$ of the resonance frequency of the $TE_{01\delta}$ mode dielectric resonator provided as a comparative example.

With respect to the resonator 81 as described above, a temperature characteristic $\eta_f^{TE010}$=49.8 ppm/°C. is obtained by calculation using equation (16). For this calculation, the temperature characteristic $\eta_e$ and the linear expansion coefficient $\alpha_d$ of the dielectric substrate 3 were respectively set to $\eta_e$=100 ppm/°C. and $\alpha_d$=5 ppm/°C., i.e., the same characteristic values as those of alumina. Also, the linear expansion coefficient of the conductor case 11 was set to $\alpha_m$=23 ppm/°C., i.e., the same characteristic value as that of hard aluminum.

Figure 19:
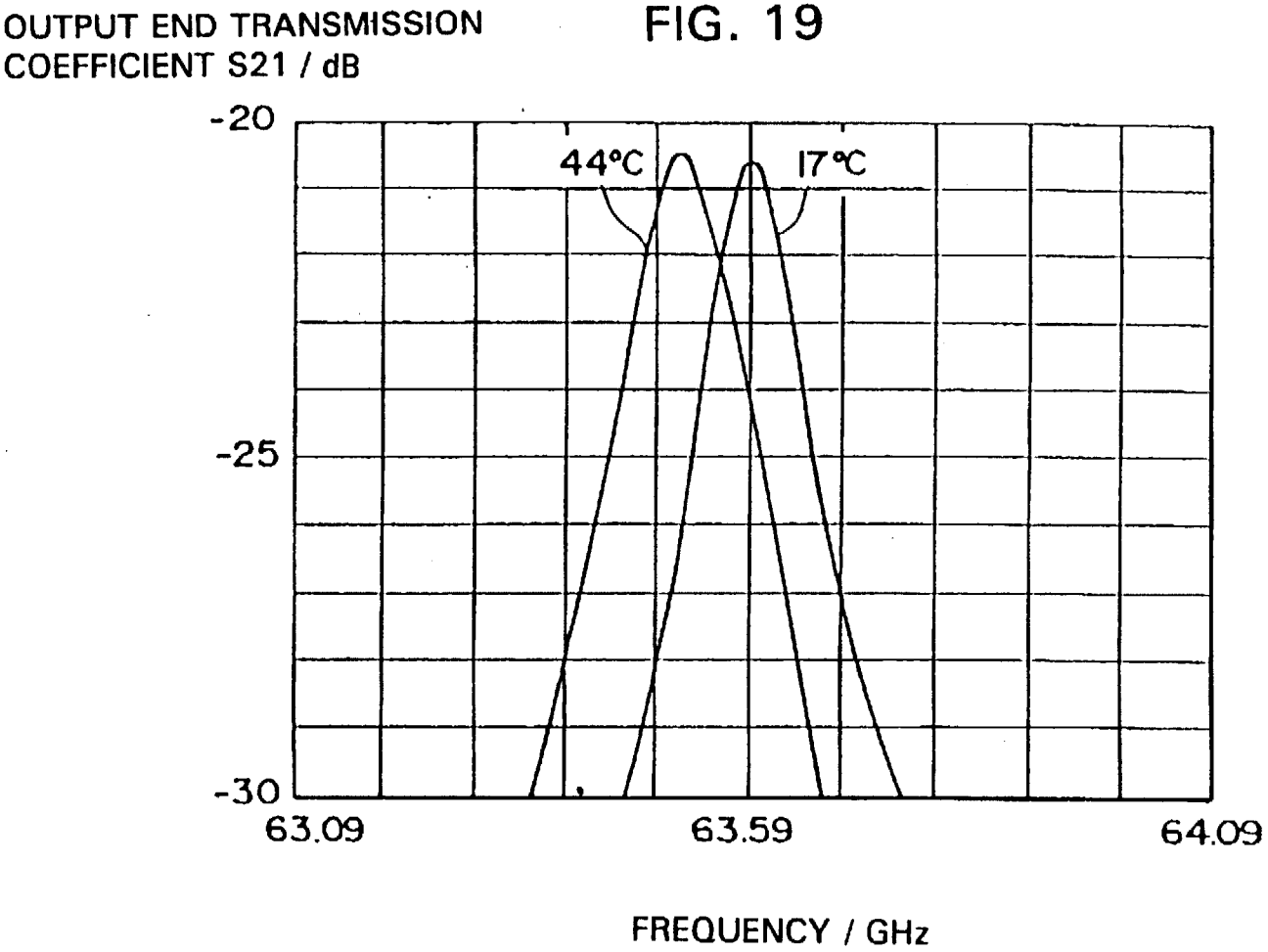
FIG. 19 is a graph showing an output end transmission coefficient $S_{21}$ when the ambient temperature of the $TE_{010}$ mode dielectric resonator of the first embodiment is 44° C. and when the ambient temperature is 17° C.
Figure 20:
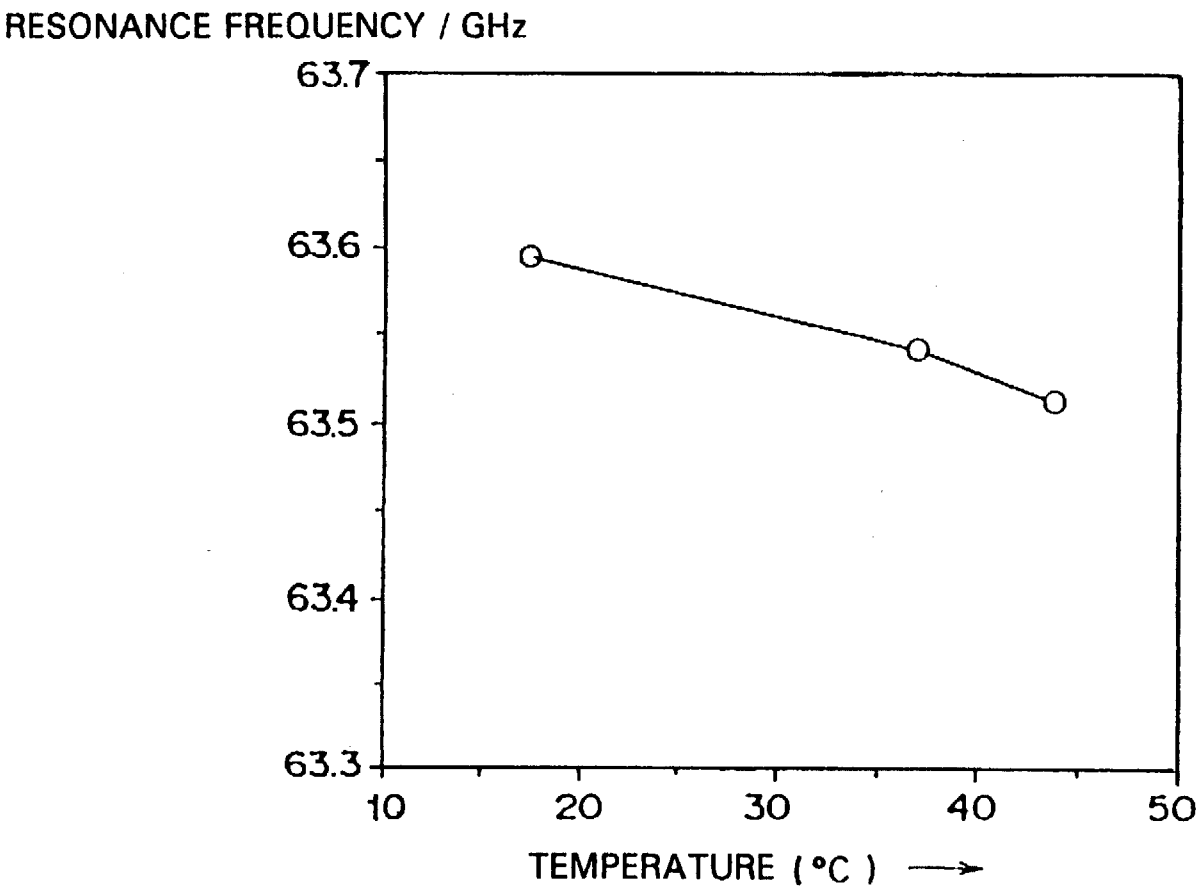
FIG. 20 is a graph showing the relationship between the resonance frequency and temperature of the $TE_{010}$ mode dielectric resonator of the first embodiment.

The result of measurement of the temperature characteristic of the resonator 81 will next be described. FIG. 19 shows resonance characteristics with respect to temperatures of 17° C. and 44° C. through output end transmission coefficient $S_{21}$. Substantially no difference is recognized between the two characteristic curves shown in the graph of FIG. 19. FIG. 20 shows a temperature dependency of the resonance frequency, the abscissa representing the temperature and the ordinate representing the resonance frequency. As clearly seen in FIG. 20, the resonance frequency changes linearly with respect to the temperature. From this result, $\eta_f^{TE010}$=48.6 ppm/°C. is obtained. This value is approximately equal to the above-mentioned theoretical value of 49.8 ppm/°C.

In the resonator 81 of the first embodiment of the present invention, the influence of the conductor case 11 upon the resonance frequency can be reduced. Therefore, if a dielectric material having a predetermined temperature characteristic is used, the resonator 81 can be formed so that variation of resonance frequency with respect to changes in temperature is smaller than that in the case of the conventional $TE_{01\delta}$ mode dielectric resonator.

In the resonator 81, the openings 4 and 5 can be formed with high accuracy by using photolithography techniques. Therefore, the resonance frequency of the resonator 81 can be accurately set to the desired value.

The resonator 81 can be manufactured in such a manner that a multiplicity of regions 60 forming resonators are formed on one dielectric substrate and this dielectric substrate is thereafter cut to form a plurality of dielectric substrate 3 at one time. In this manner, the $TE_{010}$ mode dielectric resonator 81 can be manufactured at a low cost.

The above-described $TE_{010}$ mode dielectric resonator 81 has the region 60 formed in the dielectric substrate 3, thereby facilitating coupling with other planar circuits.

<Second Embodiment>

Figure 21:
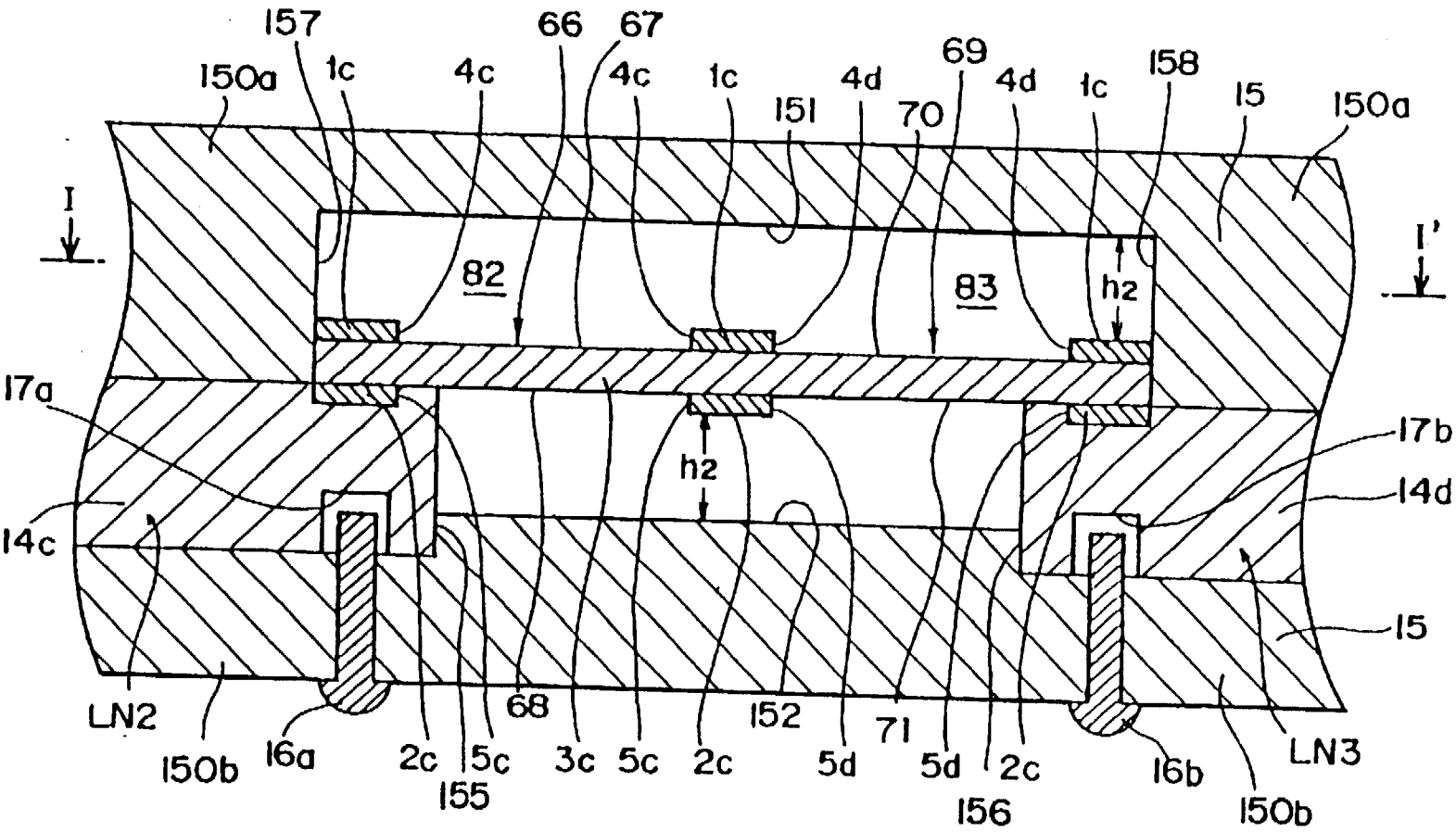
FIG. 21 is a longitudinal sectional view of a high-frequency band-pass filter device in accordance with a second embodiment of the present invention.
Figure 22:
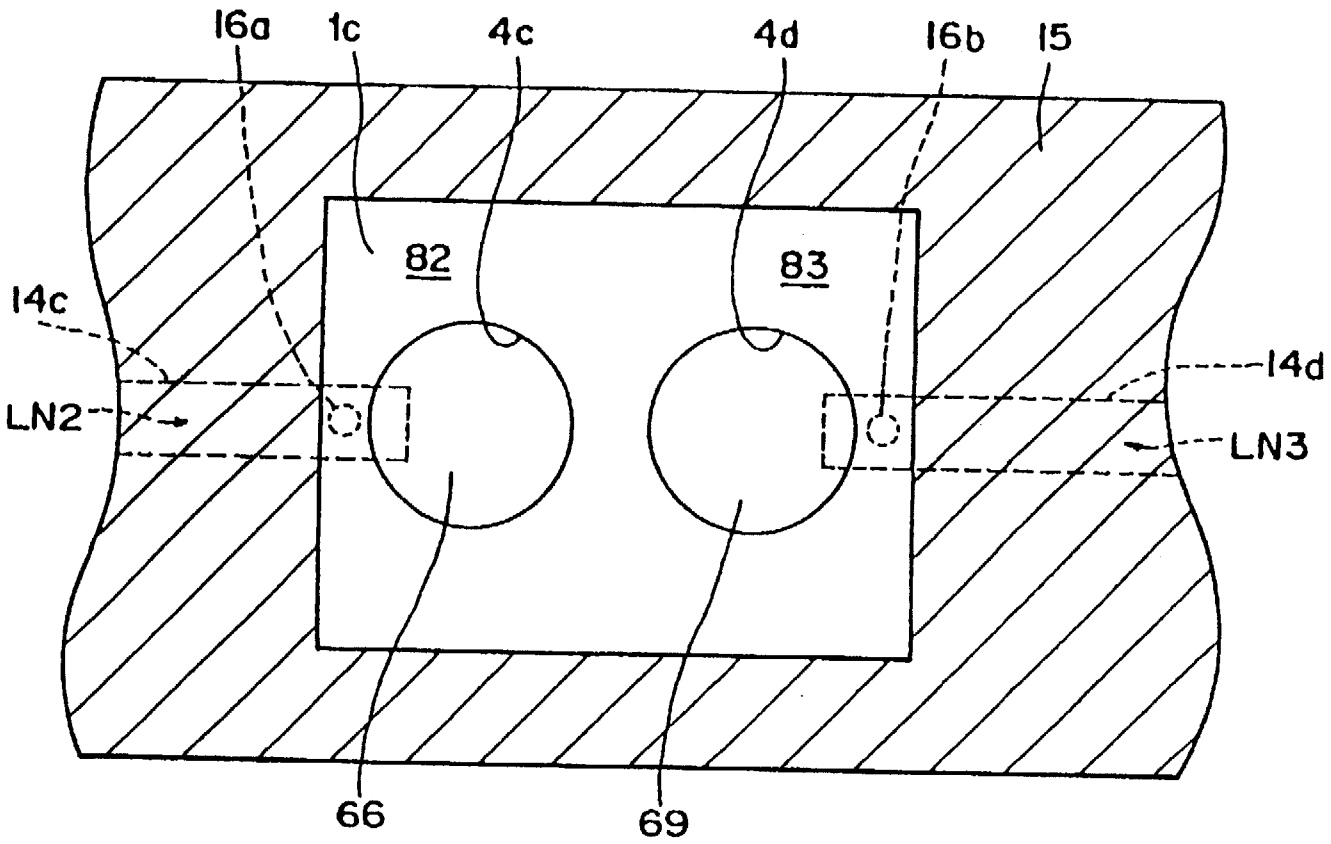
FIG. 22 is a cross-sectional view taken along the line I-I' of FIG. 21.

FIG. 21 is a longitudinal sectional view of a high-frequency band-pass filter device in accordance with a second embodiment of the present invention. FIG. 22 is a cross-sectional view taken along the line I-I' of FIG. 21. This high-frequency band-pass filter device is characterized by being constituted of a pair of $TE_{010}$ mode dielectric resonators formed by using a dielectric substrate 3c, an input NRD guide LN2 and an output NRD guide LN3.

The high-frequency band-pass filter device of the second embodiment will be described in detail with reference to the drawings.

As shown in FIGS. 21 and 22, an electrode 1c having a pair of circular openings 4c and 4d equal to each other in diameter is formed on the upper surface of the dielectric substrate 3c. An electrode 2c having the same openings 5c and 5d as the openings 4c and 4d is formed on the lower surface of the dielectric substrate 3. The dielectric substrate 3 has a predetermined dielectric constant $\epsilon_r$ and a rectangular shape. The openings 4c and 4d are formed on the upper surface of the dielectric substrate 3 by being spaced apart from each other at a predetermined distance in the longitudinal direction of the dielectric substrate 3. The openings 4c and 5c are formed coaxially with and opposite from each other and the openings 4d and 5d are formed coaxially with and opposite from each other. A pair of cylindrical regions 66 and 69 forming resonators equal to each other in shape are thereby formed in the dielectric substrate 3 adjacent to each other in the longitudinal direction of the dielectric substrate 3. The region 66 is a cylindrical portion of the dielectric substrate 3 having an upper surface 67 on the opening 4c side and a lower surface 68 on the opening 5c side. Also, the region 69 is a cylindrical portion of the dielectric substrate 3 having an upper surface 70 on the opening 4d side and a lower surface 71 on the opening 5d side. The spacing between the region 66 and the region 69 is set to a predetermined value such that a $TE_{010}$ mode dielectric resonator 82 and a $TE_{010}$ mode dielectric resonator 83 couple with each other by inductive coupling. The electrode 1c is formed on the entire area of the upper surface of the dielectric substrate 3c except for the upper surfaces 67 and 70 while the electrode 2c is formed on the entire area of the lower surface of the dielectric substrate 3c except for the lower surfaces 68 and 71.

The dielectric substrate 3c on which the electrodes 1c and 2c are formed is placed in a rectangular waveguide 15 which is formed by an upper conductor plate 150a and a lower conductor plate 150b, and which has a predetermined length, a predetermined inside guide width and a predetermined inside guide height. A recess 151 is formed in the upper conductor plate 150a at a center of the same in the longitudinal direction so as to have a predetermined depth and the same width as the inside guide width. A raised portion 152 having a predetermined length shorter than the length of the recess 151 and having a predetermined height is formed on the upper side of the lower conductor plate 150b so as to face the recess 151. The raised portion 152 has opposite end surfaces 155 and 156 parallel to end surfaces of the rectangular waveguide 15. The recess 151 has opposite end surfaces 157 and 158 parallel to the end surfaces of the rectangular waveguide 15. In this embodiment, the distance between the surface 155 of the raised portion 152 and the surface 157 of the recess 151 and the distance between the surface 156 of the raised portion 152 and the surface 158 of the recess 151 are set to predetermined values equal to each other. The input NRD guide LN2 is provided on one end surface side of the rectangular waveguide 15 in the longitudinal direction and has a dielectric member 14c in the form of a rectangular prism having a predetermined length and pinched between the upper conductor plate 150a and the lower conductor plate 150b. The dielectric member 14c is placed at a center of the rectangular waveguide 15 in the widthwise direction of the same so that its longitudinal axis is parallel to the longitudinal direction of the rectangular waveguide 15. Also, the dielectric member 14c is placed so that a portion of its one end surface contacts the surface 155 of the raised portion 152. Accordingly, the dielectric member 14c projects to a predetermined extent from the surface 157 toward the surface 158 of the recess 151. On the other hand, the output NRD guide LN3 is provided on the other end surface side of the rectangular waveguide 15 in the longitudinal direction and has a dielectric member 14d in the form of a rectangular prism having a predetermined length and pinched between the upper conductor plate 150a and the lower conductor plate 150b. The dielectric member 14d is placed at a center of the rectangular waveguide 15 in the widthwise direction of the same so that its longitudinal axis is parallel to the longitudinal direction of the rectangular waveguide 15. Also, the dielectric member 14d is placed so that a portion of its one surface contacts the surface 156 of the raised portion 152. The dielectric member 14d projects to a predetermined extent from the surface 158 toward the surface 157 of the recess 151.

The dielectric substrate 3c on which the electrodes 1c and 2c are formed is placed on the upper surface of the dielectric member 14c projecting inwardly relative to the surface 157 of the recess 151 and on the upper surface of the dielectric member 14d projecting inwardly relative to the surface 158 of the recess 151. The depth of the recess 151 and the height of the raised portion 152 are selected so that the distance between the upper surface of the electrode 1c and the bottom surface of the recess 151 and the distance between the upper surface of the raised portion 152 and the lower surface of the electrode 2c are set to the same predetermined value h2. Thus, two $TE_{010}$ mode dielectric resonators 82 and 83 coupling with each other by inductive coupling are formed at a center of the rectangular waveguide 15 adjacent to each other in the longitudinal direction of the rectangular waveguide 15.

Also, when the dielectric substrate 3c is placed on the upper surface of the dielectric member 14c, a portion of the upper surface of the dielectric member 14c and a portion of the lower end surface 68 of the region 66 are opposed to and brought into contact with each other for inductive coupling between a magnetic field of the $TE_{010}$ mode dielectric resonator 82 and a magnetic field of the input NRD guide LN2 in an $LSM_{01}$ mode which is a fundamental propagation mode of the input NRD guide LN2. Further, a recess 17a is provided in a portion of the lower surface of the dielectric member 14c opposite from the electrode 2c in contact with the upper surface of the dielectric member 14c, and a coupling adjustment screw 16a is provided so as to project into the recess 17a. If the length of the projecting portion of the coupling adjustment screw 16a in the recess 17a changes, the strength of inductive coupling between the $TE_{010}$ mode dielectric resonator 82 and the input NRD guide LN2 is changed. Accordingly, it is possible to adjust the strength of inductive coupling between the $TE_{010}$ mode dielectric resonator 82 and the input NRD guide LN2 by changing the length of the projecting portion of the coupling adjustment screw 16a in the recess 17a. Also, when the dielectric substrate 3c is placed on the upper surface of the dielectric member 14d, a portion of the upper surface of the dielectric member 14d and a portion of the lower end surface 71 of the resonator formation region 69 are opposed to and brought into contact with each other for inductive coupling between a magnetic field of the $TE_{010}$ mode dielectric resonator 83 and a magnetic field of the output NRD guide LN3 in an $LSM_{01}$ mode which is a fundamental propagation mode of the output NRD guide LN3. Further, a recess 17b is provided in a portion of the lower surface of the dielectric member 14d opposite from the electrode 2c in contact with the upper surface of the dielectric member 14d, and a coupling adjustment screw 16b is provided so as to project into the recess 17b. If the length of the projecting portion of the coupling adjustment screw 16b in the recess 17b changes, the strength of inductive coupling between the $TE_{010}$ mode dielectric resonator 83 and the output NRD guide LN3 is changed. Accordingly, it is possible to adjust the strength of inductive coupling between the $TE_{010}$ mode dielectric resonator 83 and the output NRD guide LN3 by changing the length of the projecting portion of the coupling adjustment screw 16b in the recess 17b. Thus, the high-frequency band-pass filter device of the second embodiment is constructed.

Figure 23:
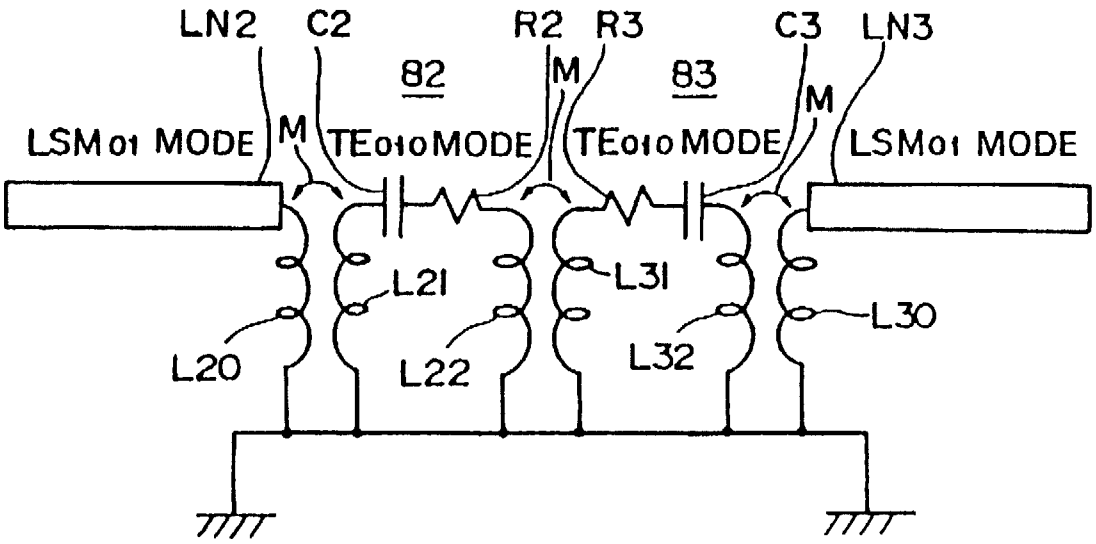
FIG. 23 is a circuit diagram showing an equivalent circuit of the high-frequency band-pass filter device of the second embodiment.

An equivalent circuit of the thus-constructed high-frequency band-pass filter device of the second embodiment will next be described. FIG. 23 is a circuit diagram of an equivalent circuit of the high-frequency band-pass filter device of the second embodiment. In this equivalent circuit, the input NRD guide LN2 is grounded through an equivalent inductor L20 at an end of the input NRD guide LN2. The $TE_{010}$ mode dielectric resonator 82 is formed in such a manner that an inductor L21, a capacitor C2, a resistor R2 and an inductor L22 are connected in series and one end of the inductor L21 and one end of the inductor L22 are grounded. The equivalent inductor L20 and inductor L21 couple with each other by inductive coupling. By this inductive coupling, the input NRD guide LN2 and the resonator 82 couple with each other. The resonator 83 is formed in such a manner that an inductor L31, a resistor R3, a capacitor C3 and an inductor L32 are connected in series and one end of the inductor L31 and one end of the inductor L32 are grounded. The inductor L22 and inductor L31 couple with each other by inductive coupling. By this inductive coupling, the resonator 82 and the resonator 83 couple with each other. The output NRD guide LN3 is formed by being grounded through an equivalent inductor L30 at an end of the output NRD guide LN3. The inductor L32 and the equivalent inductor L30 couple with each other by inductive coupling. By this inductive coupling, the resonator 83 and the output NRD guide LN3 couple with each other. Thus, the equivalent circuit of the high-frequency band-pass filter device of the second embodiment is formed.

As described above, the high-frequency band-pass filter device of the second embodiment is constructed by connecting two resonators 82 and 83 in series between input NRD guide LN2 and output NRD guide LN3. A high-frequency signal input to the input NRD guide LN2 from an external circuit is transmitted through the resonator 82 and the resonator 83 and is output from the output NRD guide LN3 to an external circuit. The resonance frequencies of the resonators 82 and 83 are set to the same frequency or frequencies slightly different from each other, thereby enabling a high-frequency signal having a corresponding predetermined frequency to pass through the high-frequency band-pass filter device of the second embodiment.

The result of analysis of a coupling coefficient of coupling between the resonators 82 and 83 will next be described. While a two-dimensional finite element method could have been used for electromagnetic field analysis of the $TE_{010}$ mode dielectric resonator 81, which is a single unit, a three-dimensional electromagnetic field calculation is required for coupling coefficient analysis. Presently, such analysis is difficult to perform if the required accuracy is high. Therefore, as described below, the principle of coupling between the resonators 82 and 83 was quantitatively grasped through an alternative proximal two-dimensional waveguide problem, and the coupling coefficient was actually determined by experiment.

Figure 24:
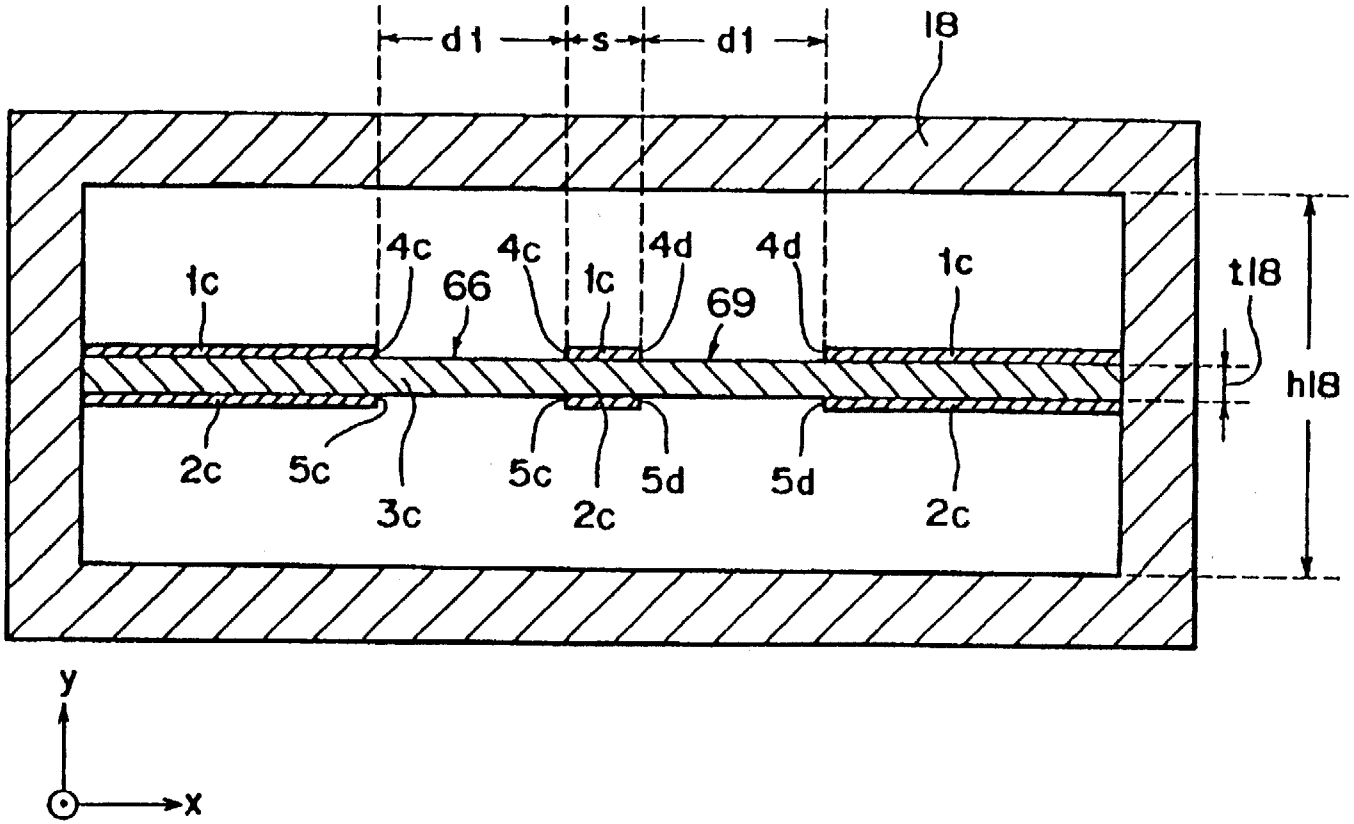
FIG. 24 is a longitudinal sectional view of a model used for analyzing the operation of the high-frequency band-pass filter device of the second embodiment.

FIG. 24 is a longitudinal sectional view of a two-dimensional waveguide model used for analysis. The two-dimensional waveguide model of FIG. 24 is formed by providing the dielectric substrate 3*c* of the second embodiment at a center of a waveguide 18. The dielectric substrate 3*c* is disposed at the center of the waveguide 18 in the direction of height thereof so that side surfaces of the dielectric substrate 3*c* contact side conductors of the waveguide, and so that upper and lower conductor plates of the waveguide 18 and the dielectric substrate 3*c* are parallel to each other. It is assumed here that the plane of the longitudinal cross section of FIG. 24, i.e., the x-y plane, corresponds to an electric wall, and that a wave travels in this waveguide in the x-direction. The x-, y- and z-directions are defined as indicated at a right-hand bottom position of FIG. 24. It is also assumed that electric fields have components only in the direction perpendicular to the traveling direction of the waveguide, i.e., z-direction components only, and have no x- and y-direction components. This model has resonance in a TE mode at such a frequency that the half wavelength is approximately equal to the width of the waveguide with respect to the traveling direction. The width of the waveguide with respect to the traveling direction is equal to the diameter d1. Also in this case, the portion of the dielectric resonator 3*c* other than the resonator formation regions 66 and 69, interposed between the electrodes 1*c* and 2*c* is a cut-off region, i.e., an attenuation region.

Figure 25:
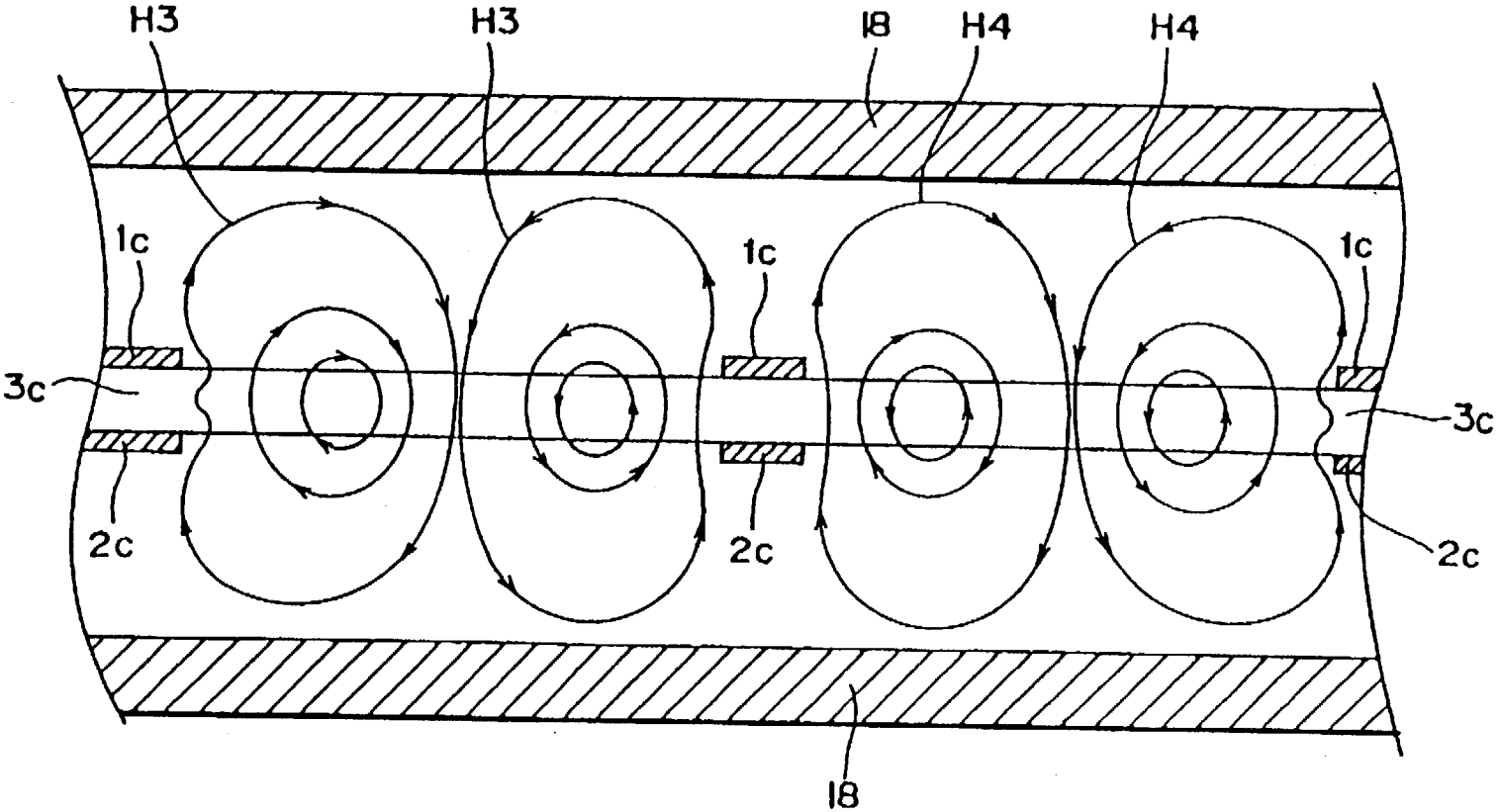
FIG. 25 is a longitudinal sectional view of the high-frequency band-pass filter device of the second embodiment, showing a magnetic field distribution in an even mode.
Figure 26:
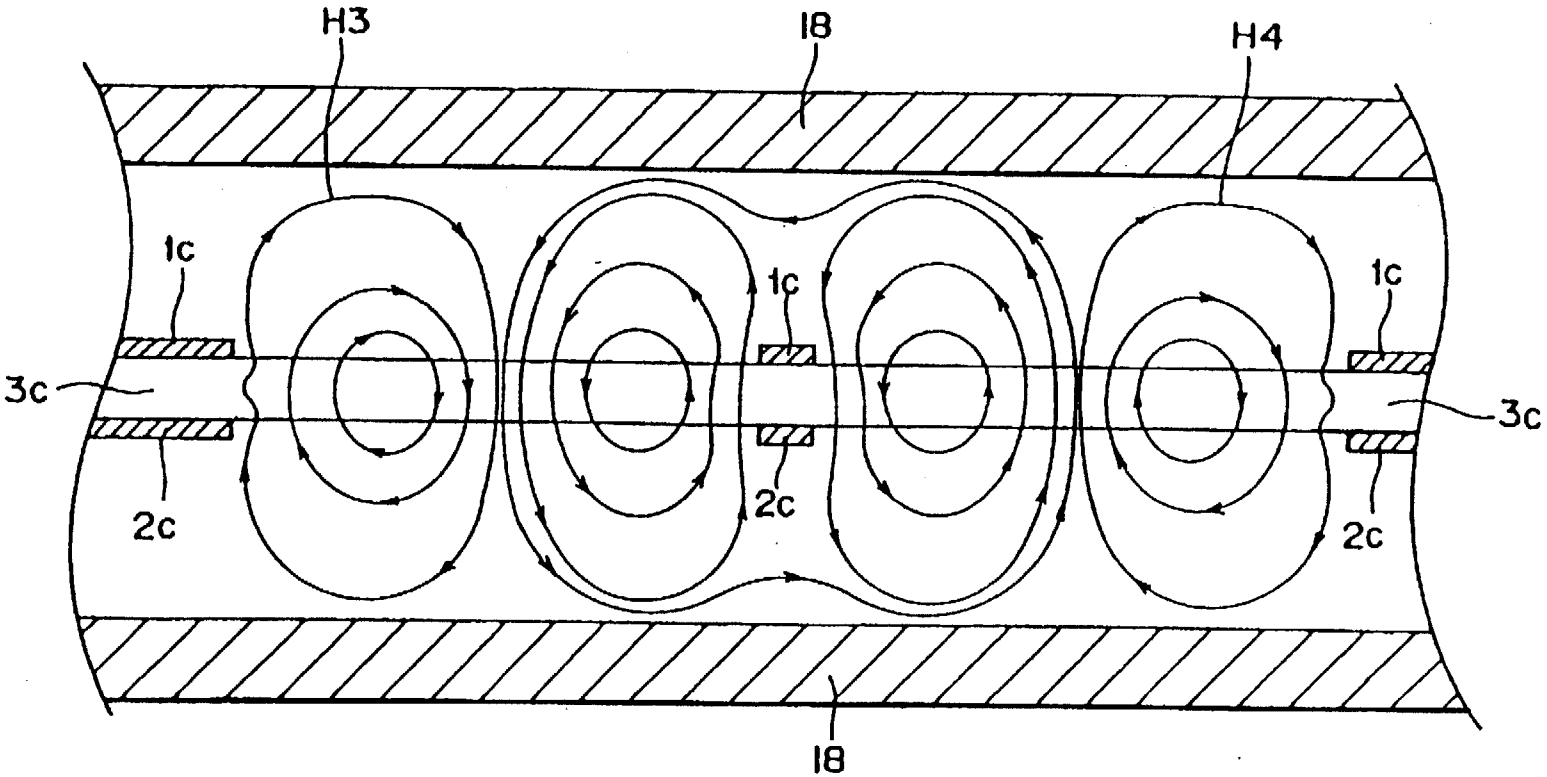
FIG. 26 is a longitudinal sectional view of the high-frequency band-pass filter device of the second embodiment, showing a magnetic field distribution in an odd mode.

FIGS. 25 and 26 respectively show magnetic field distributions along the plane of the longitudinal cross section of the thus-constructed waveguide with respect to the even mode and the odd mode in the $TE_{010}$ mode.

If the resonance frequency in the even mode and the resonance frequency in the odd mode are $f_{even}$ and $f_{odd}$, respectively, then a coupling coefficient k can be expressed by the following equation:

$$k=2(f_{odd}-f_{even})/(f_{odd}+f_{even}) \quad (18)$$

Figure 27:
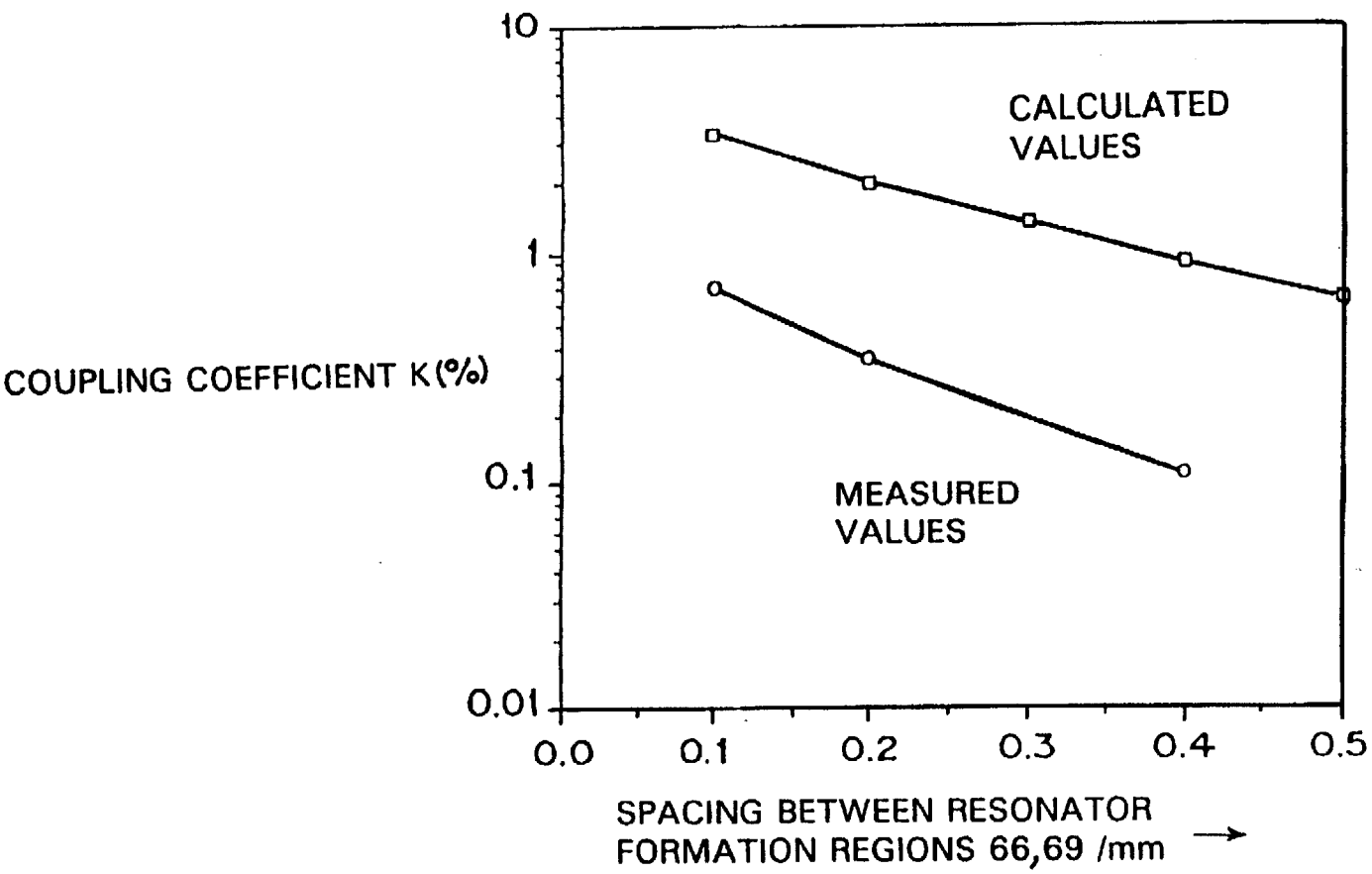
FIG. 27 is a graph showing the relationship between the coefficient of coupling between $TE_{010}$ mode dielectric resonators and the spacing between resonator formation regions in the high-frequency band-pass filter device of the second embodiment.

Values obtained from the two-dimensional waveguide model by calculation using equation (18) and values actually measured were compared, as described below. The graph of FIG. 27 shows the relationship between the coupling coefficient k and the spacing s between the resonator formation regions 66 and 69 when the spacing h18 between the upper and lower conductor plates was set to 2.25 mm. Other structural parameters were set as follows:

(1) (Diameter d1 of resonator formation regions 66 and 69)=3.26 mm, (2) (Dielectric constant $\epsilon_r$ of dielectric substrate 3*c*)=9.3, and (3) (Thickness t of dielectric substrate 3*c*)=0.33.

Figure 28:
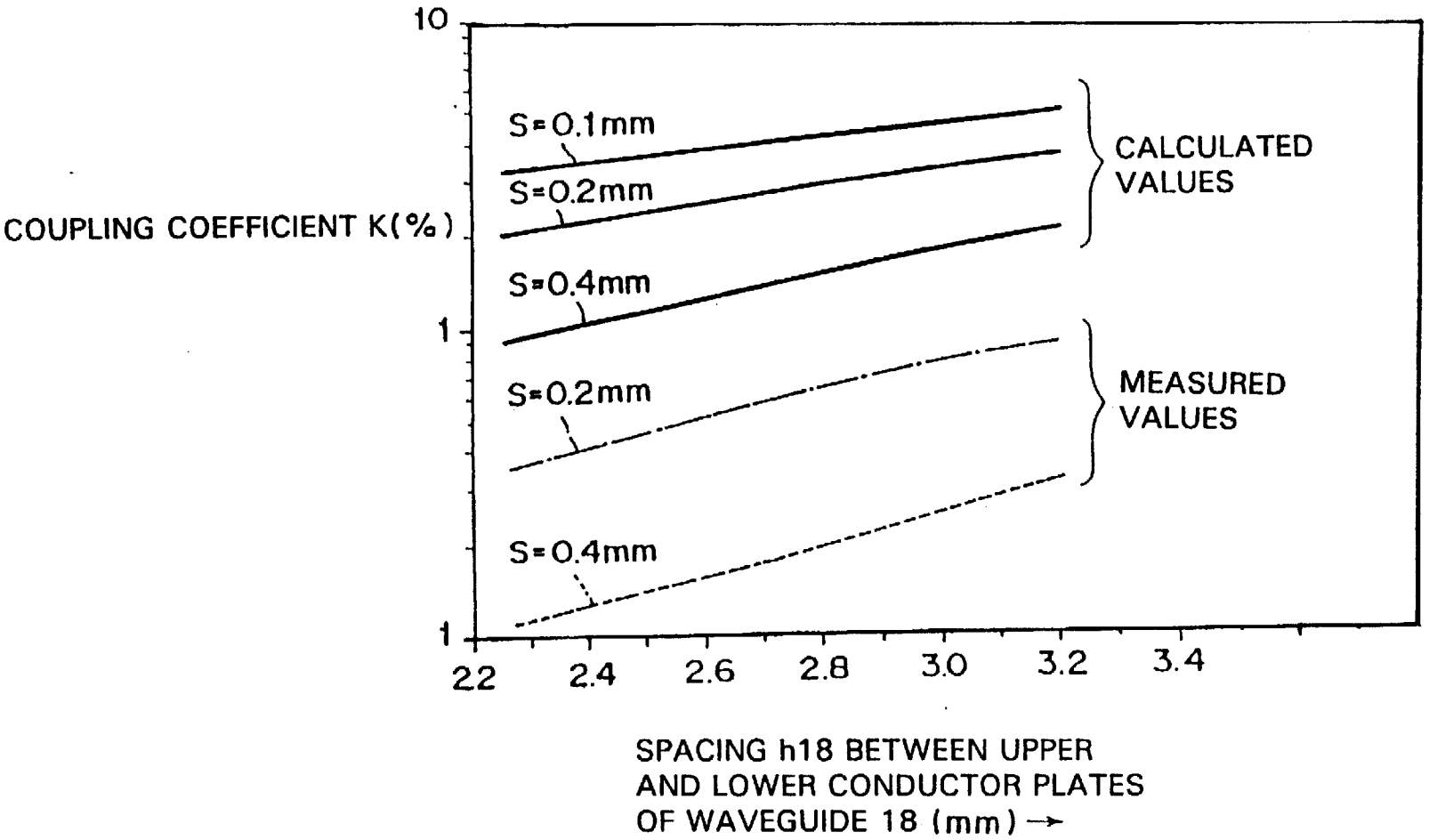
FIG. 28 is a graph showing the relationship between the coupling coefficient and the spacing between the upper and lower conductor plates of a waveguide in the high-frequency band-pass filter device of the second embodiment.

As shown in FIG. 27, the measured values are about ¼ of the calculated values, but they have substantially the same inclination. Thus, it was found that this model well represents the tendency of the actual state of coupling. To achieve stronger coupling, the cut-off effect between the resonators may be reduced by increasing the distance between the upper and lower conductor plates. FIG. 28 shows the relationship between the coupling coefficient k and the distance h18 between the upper and lower conductor plates. In FIG. 28, calculated values are shown with respect to three values of the spacing s between the resonators, i.e., s=0.1 mm, s=0.2 mm, and s=0.4 mm while measured values are shown with respect to s=0.2 mm and s=0.4 mm. As is apparent from FIG. 28, if the spacing h18 between the upper and lower conductor plates is increased, the coupling coefficient is also increased.

A filter device was manufactured in accordance with the above-described high-frequency band-pass filter device of the second embodiment. The result of evaluation of this manufactured filter device will next be described. Table 2 shows target characteristics of the manufactured high-frequency band-pass filter device.

In this manufacture, the percentage pass band width is set to a very narrow range of about 0.2%.

TABLE 2

| Target Charaateristics of Filter Device | |
|---|---|
| Center Frequency $f_0$ | 61.0 GHz |
| Passband Width BW | 100 MHz |
| Insertion Loss IL | 3.0 dB or less |
| Reflection Loss RL | 15 dB or more |
| Amount of Attenuation (in a frequency range of f0 ± 1 GHz) | 30 dB or more |

Figure 29:
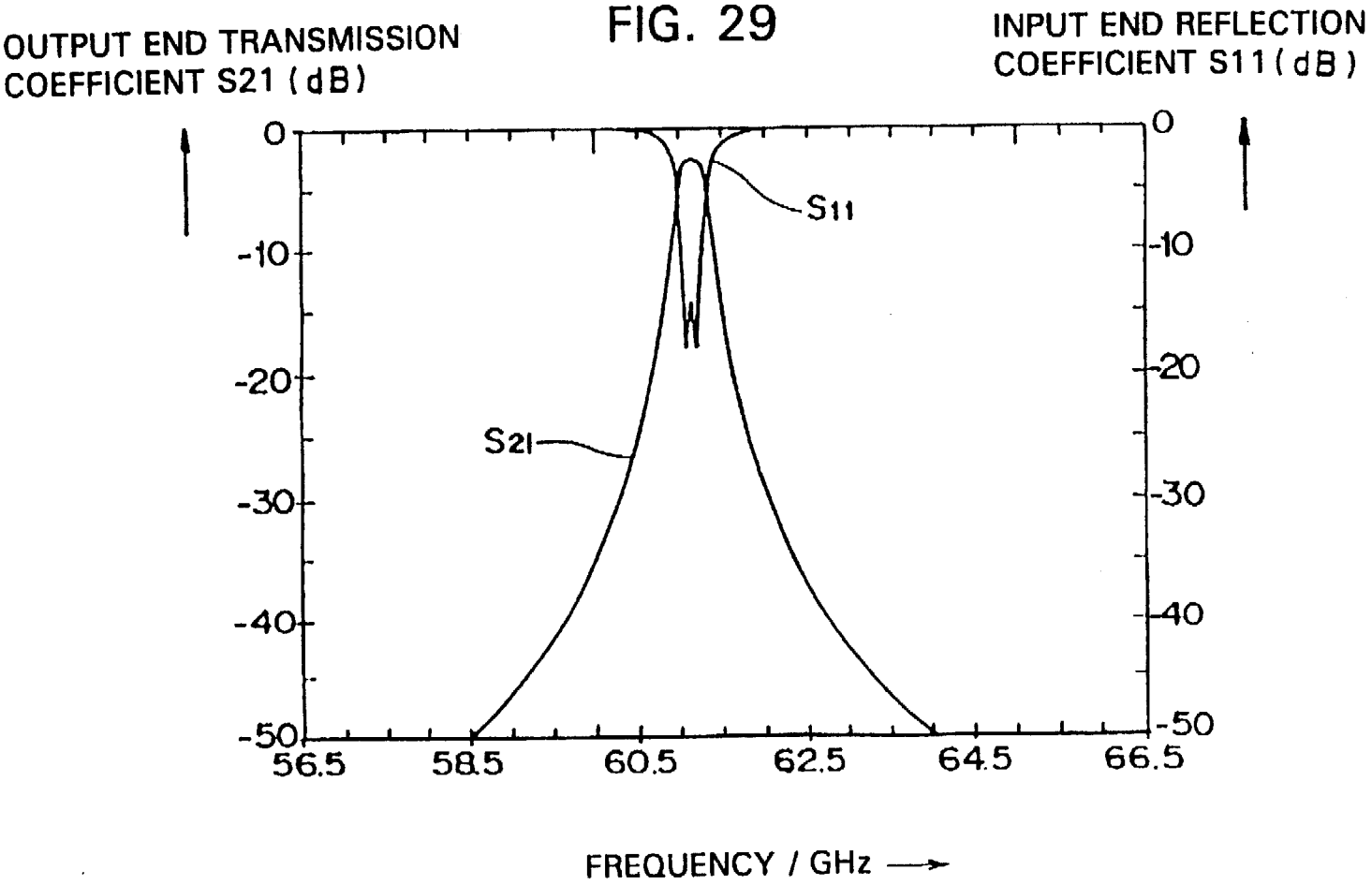
FIG. 29 is a graph showing calculated values of output end transmission coefficient $S_{21}$ and input end transmission coefficient $S_{11}$ of the high-frequency band-pass filter device of the second embodiment.

Table 3 shows design parameters of the filter device set to obtain the target characteristics shown in Table 2. From a calculation result, it was found that it is necessary to set the non-load Q of the $TE_{010}$ mode dielectric resonator to 1000 or more. In Table 3, resonance frequencies $f_1$ and $f_2$ represent the resonance frequencies of the $TE_{010}$ mode dielectric resonators 82 and 83, a coupling coefficient $k_{12}$ represents the coefficient of coupling between the $TE_{010}$ mode dielectric resonators 82 and 83, and external $Q_{e1}$ and $Q_{e2}$ represent the external Q between the NRD guide LN2 and the $TE_{010}$ mode dielectric resonator 82 and the external Q between the NRD guide LN3 and the $TE_{010}$ mode dielectric resonator 83. FIG. 29 shows filter characteristics obtained by simulation on the basis of the design parameters shown in Table 3. In FIG. 29, the filter characteristics are represented by output end transmission coefficient $S_{21}$ and input end reflection coefficient S11 with respect to the frequency.

TABLE 3

| Design parameters of Filter Device | |
|---|---|
| Center frequency $f_0$ | 61.0 GHz |
| Design Passband Width | 200 MHz |
| Design Ripple | 0.1 dB (Chebyshev Type) |

TABLE 3-continued

| Design parameters of Filter Device | |
|---|---|
| Resonance Frequency $f_1$ (=f2) | 60.5 GHz |
| Coupling Coefficient $k_{12}$ | 0.40% |
| External Q $Q_{e1}$ (=$Q_{e2}$) | 3.20 (mm) |

Structural parameters of the high-frequency band-pass filter device of the second embodiment were calculated on the basis of the above-described results of analysis of the $TE_{010}$ mode dielectric resonators 82 and 83 20 and the coupling coefficient and on the basis of the filter design parameters shown in Table 3. Table 4 shows the structural parameters thereby obtained.

TABLE 4

| Structural Parameters of Filter Device | |
|---|---|
| Diameter d1 of Resonator Formation Regions 66 and 69 | 3.26 (mm) |
| Spacing s between Resonator Formation Regions 66 and 69 | 0.40 (mm) |
| Spacing h18 between Upper and Lower Conductor Plates | 3.20 (mm) |

Figure 30:
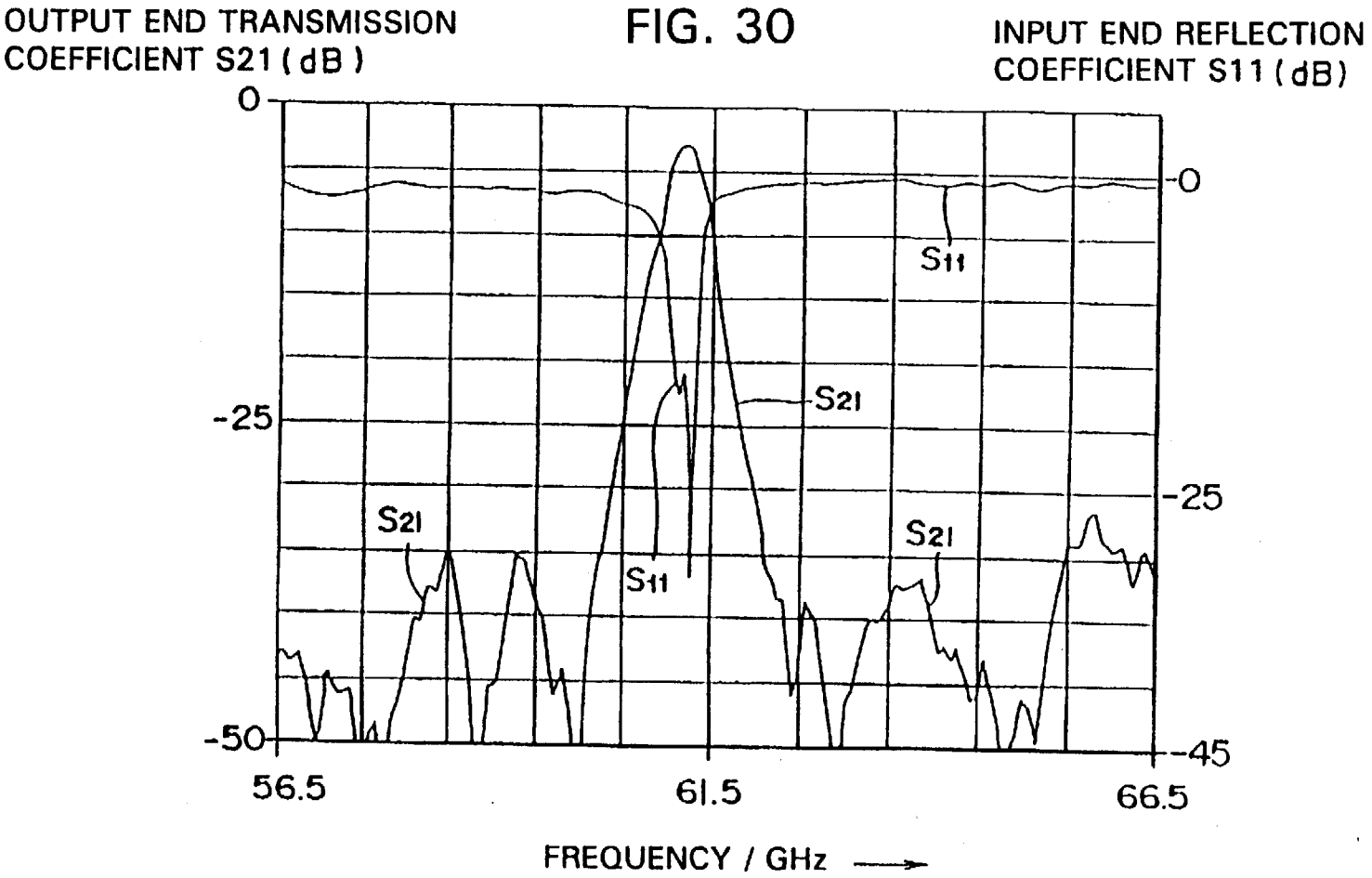
FIG. 30 is a graph showing measured values of output end transmission coefficient $S_{21}$ and input end transmission coefficient $S_{11}$ of the high-frequency band-pass filter device of the second embodiment.

The high-frequency band-pass filter device was manufactured on the basis of the structural parameters shown in Table 4 and was evaluated as described below. The size of the manufactured high-frequency band-pass filter device was 10×11×3.2 mm. FIG. 30 is a graph showing measured values of the filter characteristics. In FIG. 30, the filter characteristics are represented by output end transmission coefficient $S_{21}$ and input end reflection coefficient $S_{11}$ with respect to the frequency.

A significant match is recognized between the attenuation curve formed by output end transmission coefficient $S_{21}$ and the values shown in FIG. 29. The calculated insertion loss is 2.0 dB while the measured insertion loss is 2.4 dB. It can be supposed that the cause of this difference is a reduction of the non-load Q of the resonators 82 and 83 caused by local concentrations of currents on the periphery of the resonators 82 and 83 due to strong coupling between the input and output NRD guides LN2 and LN3 and the resonators 82 and 83, or by coupling of the resonating electromagnetic field with TEM modes other than the fundamental resonance mode. Therefore, a small-loss filter can be realized if such a reduction in non-load Q is prevented by applying a structure for electromagnetic symmetrization, a mode suppresser or the like to coupling between the $LSM_{01}$ mode of the input and output NRD guides LN2 and LN3 and the $TE_{010}$ mode of the resonators 82 and 83. Also, a wide-band multi-stage filter having three or more stages may be designed to achieve a small-loss characteristic by using $TE_{010}$ mode dielectric resonators other than those at the opposite ends coupled with input NRD guides LN2 and LN3 under such a condition that the non-load Q is high.

In the above-described high-frequency band-pass filter device of the second embodiment, the openings 4*c*, 4*d*, 5*c* and 5*d* are formed in one dielectric substrate 3*c* by using photolithography techniques, thereby enabling the diameters of the openings 4*c*, 4*d*, 5*c* and 5*d* to be set with high accuracy. Accordingly, the resonance frequency of each of resonators 82 and 83 can be set with high accuracy. Also, because the spacing s between the opening 4*c* and the opening 4*d* and the spacing s between the opening 5*c* and the opening 5*d* can be set with high accuracy, the coefficient of coupling between two resonators 82 and 83 can be set to the desired value with high accuracy. Accordingly, it is possible to provide a high-frequency band-pass filter which can be used without being adjusted.

The high-frequency band-pass filter of the second embodiment can be manufactured in such a manner that a multiplicity of resonator formation regions 66 and 69 are formed in one dielectric substrate and the dielectric substrate is thereafter cut to form a plurality of dielectric substrate 3 at one time. In this manner, the high-frequency band-pass filter can be manufactured at a low cost.

Since the high-frequency band-pass filter of the second embodiment has its resonator formation regions 66 and 69 formed in a dielectric substrate 3, it can easily be coupled with other planar circuits, e.g., a microwave IC (MIC), monolithic microwave IC (MMIC) and the like.

<Examples of Modifications>

In the above-described first and second embodiments of the present invention, the openings 4, 4*c*, 4*d*, 5, 5*c*, and 5*d* are formed so as to be circular. According to the present invention, however, the openings may have any other shape such as a square or polygonal shape. A filter having such an opening can also operate in the same manner and have the same advantages as the first and second embodiments.

The device of the above-described first or second embodiment is constructed by using a conductor case 11 or a rectangular waveguide 15. However, the present invention is not limited to this device and also includes a construction using only upper and lower conductor plates in place of such a case or waveguide. Also in such a case, the same operation and the same advantages as those of the first or second embodiment can be achieved.

The high-frequency band-pass filter of the second embodiment is constructed by using input NRD guide LN2 and output NRD guide LN3. However, the present invention is not limited to this arrangement and also includes an arrangement using any other types of transmission lines such as microstrip lines, coplanar lines or waveguides. Also in such a case, the same operation and the same advantages as those of the first or second embodiment can be achieved.

What is claimed is:

1. A dielectric resonator device comprising:

a dielectric substrate having a first surface and a second surface opposite from each other;

a first electrode formed on the first surface of said dielectric substrate;

a first opening formed in the first electrode on the first surface of said dielectric substrate;

a second electrode formed on the second surface of said dielectric substrate:

a second opening in the second electrode formed in substantially the same shape as said first opening and positioned substantially opposite from said first opening;

a first conductor plate disposed by being spaced apart from the first surface of said dielectric substrate by a predetermined distance, a portion of said first conductor plate facing said first opening; and a second conductor plate disposed by being spaced apart from the second surface of said dielectric substrate by a predetermined distance, a portion of said second conductor plate facing said second opening;

an input device for inputting a signal to said dielectric resonator; and an output device for outputting a signal from said dielectric resonator, wherein at least one of said input device and said output device comprises a nonradiative dielectric waveguide.

2. A dielectric resonator device according to claim 1, wherein said input device comprises a non-radiative dielectric waveguide.

3. A dielectric resonator device according to claim 1, wherein said output device comprises a non-radiative dielectric waveguide.

4. A dielectric resonator device according to claim 1, wherein both said input and output devices each comprise a non-radiative dielectric waveguide.

5. A high-frequency band-pass filter device comprising:

a plurality of dielectric resonators arranged at predetermined intervals, each of said dielectric resonators having:

a dielectric substrate having a first surface and a second surface opposite from each other;

a first electrode formed on the first surface of said dielectric substrate;

a first opening formed in the first electrode on the first surface of said dielectric substrate;

a second electrode formed on the second surface of said dielectric substrate:

a second opening in the second electrode formed in substantially the same shape as said first opening and positioned substantially opposite from said first opening;

a first conductor plate disposed by being spaced apart from the first surface of said dielectric substrate by a predetermined distance, a portion of said first conductor plate facing said first opening; and a second conductor plate disposed by being spaced apart from the second surface of said dielectric substrate by a predetermined distance, a portion of said second conductor plate facing said second opening;

an input device for inputting a high-frequency signal to said dielectric resonators; and an output device for outputting a high-frequency signal from said dielectric resonators, wherein at least one of said input device and said output device comprises a nonradiative dielectric waveguide.

6. A high-frequency band-pass filter device according to claim 5, wherein said input device comprises a non-radiative dielectric waveguide.

7. A high-frequency band-pass filter device according to claim 5, wherein said output device comprises a non-radiative dielectric waveguide.

8. A high-frequency band-pass filter device according to claim 5, wherein both said input and output devices each comprise a non-radiative dielectric waveguide.

* * * * *